US006633116B1

(12) United States Patent
Lee

(10) Patent No.: US 6,633,116 B1
(45) Date of Patent: Oct. 14, 2003

(54) FERRITE CORE IN DEFLECTION YOKE FOR BRAUN TUBE

(75) Inventor: Seok Moon Lee, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 303 days.

(21) Appl. No.: 09/714,139

(22) Filed: Nov. 17, 2000

(30) Foreign Application Priority Data

Nov. 19, 1999 (KR) ..... 1999-51421
Sep. 8, 2000 (KR) ..... 2000-83480

(51) Int. Cl.[7] ..... H01J 29/70
(52) U.S. Cl. ..... 313/440; 335/210; 335/213
(58) Field of Search ..... 313/440; 335/210–213

(56) References Cited

U.S. PATENT DOCUMENTS 6,452,321 B1 * 9/2002 Kojima ..... 313/440

* cited by examiner

*Primary Examiner*—Robert H. Kim
*Assistant Examiner*—Jurie Yun
(74) *Attorney, Agent, or Firm*—Birch, Stewart, Kolasch & Birch, LLP

(57) ABSTRACT

Deflection yoke for a cathode ray tube including horizontal and vertical deflection coils for deflecting electron beams emitted from an electron gun in a horizontal or vertical direction, a ferrite core for reducing a loss of a magnetic force generated at the horizontal and vertical deflection coils to enhance a magnetic efficiency, and a holder for fixing the horizontal and vertical deflection coils and the ferrite core to preset positions, and insulating between the horizontal deflection coils and the vertical deflection coils, wherein the ferrite core includes a main ferrite core with a curved surface and supplementary ferrite cores each with a planar surface fitted to the main ferrite core, thereby maintaining advantages of the rectangular core of improving a deflection sensitivity compared to the circular ferrite core, and permitting easier grinding on an internal surface compared to the rectangular ferrite core, to improve a distribution of inside surface dimensions.

45 Claims, 22 Drawing Sheets

FERRITE CORE IN DEFLECTION YOKE FOR BRAUN TUBE

BACKGROUND OF THE INVENTION

1. Field of the Invention

The present invention relates to a deflection yoke for a Braun tube, and more particularly, to a ferrite core in a RAC type deflection yoke employed for improving a deflection sensitivity of a Braun tube.

2. Background of the Related Art

In general, a color Braun tube is provided with an in-line type electron gun, in which a self-converging type deflection yoke with a non-uniform magnetic field is employed for converging three electron beams onto one dot on a fluorescent film as red(R), green(G), and blue(B) electron beams are emitted arranged on a horizontal line in parallel. Referring to FIGS. 1~2B, a related art color cathode ray tube, and a RAC type deflection yoke applied thereto will be explained.

Referring to FIG. 1, the related art color cathode ray tube is provided with a panel 1 forming a front surface thereof, a fluorescent film 3 on an inside surface of the panel 1 having a coat of red(R), green(G), and blue(B) fluorescent materials applied thereon, a shadow mask 2 in rear of the fluorescent film 3 for selection of colors of the electron beams incident to the fluorescent film 3, a funnel 6 welded to a rear of the panel 1, an electron gun 5 fitted inside of a neck part in a rear portion of the funnel 6 for emission of electron beams 7, and a RAC type deflection yoke 4 mounted to surround an outer circumference of the neck part in the rear portion of the funnel 6 for deflection of the electron beams emitted from the electron gun in a horizontal or vertical direction.

And, referring to FIGS. 2A and 2B, the RAC type deflection yoke 4 is provided with one pair of horizontal deflection coils 41 for deflecting the electron beams emitted from the electron gun 5 in the cathode ray tube in a horizontal direction, one pair of vertical deflection coils 42 for deflecting the electron beams in a vertical direction, a ferrite core 44 for reducing losses of magnetic forces generated by currents in the horizontal deflection coil 41 and the vertical deflection coil 42 to enhance a deflection efficiency, a holder 43 for fixing relative positions of the horizontal deflection coils 41, the vertical deflection coils 42, and the ferrite core 44, physically holding and fastening the same, and insulating between the horizontal deflection coils 41 and the vertical deflection coils 42 and fastening the horizontal deflection coils 41 and the vertical deflection coils 42 to the cathode ray tube, a COMA free coil 45 mostly fitted to a neck side of the holder 43 for improving a coma aberration generated by a vertical barrel type magnetic field, a ring band 46 fitted to a neck side of the holder 43 for fastening the cathode ray tube and the deflection yokes 4 physically, and magnets 47 fitted to an opening side of the deflection yokes for correction of raster distortion of a picture.

In the meantime, referring to FIGS. 3~4C, the rectangular ferrite core in the related art RAC type deflection yoke, and the vertical deflection coils fastened to the ferrite core will be explained in detail. FIG. 3 illustrates a perspective view of the rectangular ferrite core in FIG. 2A.

Referring to FIG. 3, the related art ferrite core 44 is provided with, when the related art ferrite core 44 is compared to the cathode ray tube, a small sized neck portion 44*c* identical to the neck part of the cathode ray tube, an opening portion 44*a* large sized compared to the neck portion 44*c* identical to a screen side of the cathode ray tube, and an intermediate portion 44*b*, an intermediate region of the neck portion 44*c* and the opening portion 44*a*. Particularly, the ferrite core has a section circular at the neck portion 44*c*, which gradually becomes non-circular as the section goes from the neck portion 44*c* to the opening portion 44*a* which is rectangular. That is, the intermediate portion 44*b* is a region of transition from a circle to a rectangle, and dashed lines in the intermediate portion 44*b* in FIG. 3 indicate a point P where the transition from a circle to a rectangle starts.

FIG. 4A illustrates a perspective view of the vertical deflection coils in FIG. 2A, FIG. 4B illustrates a front view of FIG. 4A, and FIG. 4C illustrates a side view of FIG. 4A.

Referring to FIGS. 4A~4C, the vertical deflection coils 42 are disposed on an inside of the rectangular ferrite core 44 and has a contour substantially similar to the foregoing ferrite core. That is, identical to the rectangular ferrite core 44, the vertical deflection coils 42 also has a small sized neck portion 42*c* substantially similar to the neck part of the cathode ray tube, a large sized opening portion 42*a* substantially similar to a screen side form of the cathode ray tube, and an intermediate portion 42*b* which is an intermediate region of the neck portion 42*c* and the opening portion 42*a*. And, the vertical deflection coils 42 collectively have a section circular at the neck portion 42*c*, which gradually becomes non-circular as the section goes from the neck portion 42*c* to the opening portion 42*a* which is rectangular. That is, the vertical deflection coils 42 also have a point P of transition from a circle to a rectangle and the intermediate portion 42*b*, a region of transition from a circle to a rectangle starting from the point of transition.

In the meantime, the regions of transition from a circle to a rectangle of the rectangular ferrite core 44 and the vertical deflection coils 42 have a ratio of transition from a circle to a rectangle which becomes the greater as the region goes from the neck portion to the opening portion. The ratio of transition from a circle to a rectangle is defined as follows.

Referring to FIG. 6, a circle is drawn centered on a corner of a square which has a length HL in a horizontal direction axis 'H' and a length VL in a vertical direction axis 'V', taking a diagonal line as a radius 'R'. And, )H is defined as a difference between the radius R and the horizontal side length of the square HL, and )V is defined as a difference between the radius R and the vertical side length of the square VL. And, a sum of )H and )V is defined as )HV, i.e., )HV=)H+)V, and the ratio of transition(transition ratio) from a circle to a rectangle is defined to be )HV/R. In a case of a true circle, when both )H and )V are "0", the transition ratio is "0", and in a case of a square, the transition ratio is approx. 0.6.

The operation of the aforementioned RAC type deflection yoke 4 will be explained.

In general, the horizontal deflection coils 41 have currents with a frequency equal to 15.75 KHz or over applied thereto, for deflecting the electron beams in the cathode ray tube in a horizontal direction by using a magnetic field formed as the currents are applied thereto. And, in general the vertical deflection coils 42 have currents with a 60 Hz frequency applied thereto, for deflecting the electron beams in a vertical direction by using a magnetic field formed as the currents are applied thereto. In the meantime, recently, self-convergence type deflection yokes are developed mostly, which permits convergence of the three electron beams on a screen by using a non-uniform magnetic field formed by the horizontal deflection coil 41 and the vertical deflection coil 42, without using any additional circuits or devices, separately. That is, distributions of wounds of the horizontal deflection coils 41 and the vertical deflection coils 42 are adjusted, such that magnetic fields at respective portions(the opening portion, the intermediate portion, and the neck portion) are a barrel form or a pin-cushion form, for exerting different deflection forces to the three electron beams depending on positions of the three electron beams so as to converge the three electron beams which have different distances from starting points to arrival points onto the same point. Moreover, in the case of magnetic field formation by applying the currents to the horizontal deflection coils 41 and the vertical deflection coils 42, since the deflection of the electron beams throughout the entire surface of the screen only by using the horizontal deflection coils 41 and the vertical deflection coils 42 is not adequate, the ferrite core 44 of a high magnetic permeability is used for minimizing a loss a magnetic force in a returning path of the magnetic flux, to enhance an efficiency of the magnetic field, and, thereby enhancing a magnetic force.

And, referring to FIGS. 5A and 5B, the horizontal deflection coils 41 have an upper and a lower coils 41U and 41L connected in parallel, to which a horizontal deflection current of a saw tooth wave form is applied for forming a horizontal deflection magnetic field of a pin-cushion type so as to deflect the three electron beams (i.e., red, green, and blue electron beams) emitted from the electron gun 5 in a horizontal direction, as the force exerting on the electron beam by the horizontal deflection magnetic field is inversely proportional to a third power of a distance between an inside surface of the horizontal deflection coil and the electron beam according to the Flemming's left-hand rule. The RAC type deflection yoke 4 can improve a deflection sensitivity compared to a circular deflection yoke in the related art because both the rectangular deflection coils 41 and 42 and the ferrite core 44 lead the distance to the electron beams to be closer than the circular deflection yoke. That is, the rectangular deflection coils 41 and 42 and the ferrite core 44 in the deflection yoke lead the distance from the electron beams to the deflection coils closer by approx. 20% compared to the circular deflection yoke in the related art, the rectangular deflection coils 41 and 42 and the ferrite core 44 have approx. 20~30% improved horizontal and vertical deflection sensitivities.

However, the foregoing rectangular ferrite core has a formation error in a level of ∀2% because a percentage of contraction of the material reaches to as much as 20%. Particularly, the rectangular ferrite core formed to improve the sensitivity of the deflection yoke 4 results in a greater formation error. That is, since the rectangular ferrite core should be formed to have different length and width, and a circular neck portion 44*c* and a rectangular opening portion 44*a* with a transitory intermediate portion 44*b*, an error in grinding the ferrite core becomes more than three times at the maximum compared to the circular core in the related art. The rectangular ferrite core with the regions of transition from a circle to a rectangle in the related art has a difficulty in managing dimensions accurately as the grinding of the transition region is difficult, that results in a production yield of the rectangular core no more than 50% of the circular ferrite core, with a unit cost approx. 200% higher than the circular ferrite core.

SUMMARY OF THE INVENTION

Accordingly, the present invention is directed to a deflection yoke for a cathode ray tube that substantially obviates one or more of the problems due to limitations and disadvantages of the related art.

An object of the present invention is to provide a deflection yoke for a cathode ray tube, which can maintain advantages of the rectangular ferrite core of improving a deflection sensitivity as they are, but permits an easy inside surface grinding and improves distribution of an inside dimension.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the deflection yoke for a cathode ray tube includes horizontal deflection coils and vertical deflection coils for deflecting electron beams emitted from an electron gun in a horizontal or vertical direction, a ferrite core for reducing a loss of a magnetic force generated at the horizontal and vertical deflection coils to enhance a magnetic efficiency, and a holder for fixing the horizontal deflection coils and the vertical deflection coils and the ferrite core to preset positions, and insulating between the horizontal deflection coils and the vertical deflection coils, wherein the ferrite core includes a main ferrite core with a curved surface and supplementary ferrite cores each with a planar surface fitted to the main ferrite core.

The main ferrite core includes planar surfaces on an opening portion side of the main ferrite core for fitting the supplementary ferrite core a top portion and a bottom portion of the main ferrite core.

The planar surface is formed starting from the opening portion toward the neck portion direction, at a ratio of a length of the planar surface to an entire length of the main ferrite core in an axis direction of the cathode ray tube being 5%~70%.

The planar surface started from the opening portion toward the neck portion direction is formed such that an angle between a line connecting an inner front edge of the opening portion which has an arc form and a center of the opening portion of the main ferrite core and a horizontal line passed through the center of the opening portion is 20E~80E when the main ferrite core is seen from a screen side.

The angle between the line connecting an inner front edge of the opening portion which has an arc form and a center of the opening portion of the main ferrite core and a horizontal line passed through the center of the opening portion is preferably 36.7E.

Of an entire length of the main ferrite core in an axis direction of the cathode ray tube the planar surface is formed starting from points in front of points on an outer circumference of the main ferrite core onto which the region the transition from a circle to a rectangle of the vertical deflection coils starts are projected.

Particularly, of an entire length of the main ferrite core in an axis direction of the cathode ray tube, the planar surface is formed starting from points in front of points on an outer circumference of the main ferrite core onto which points of the vertical deflection coils of which transition ratio are 0.3 are projected.

The planar surface in the main ferrite core is formed in parallel to the axis of the cathode ray tube, or sloped at an angle to the axis of the cathode ray tube.

A section of the main ferrite core in parallel to a surface of the opening at any point of the axis of the cathode ray tube has concentric circles or arcs.

The supplementary ferrite core is a plate with a thickness having a width which becomes the smaller as it goes the farther from the opening portion side toward the neck portion side of the main ferrite core, or a rectangular in a plan view.

The supplementary ferrite core is a plate with a thickness having a width which becomes the smaller as it goes the farther from the opening portion side toward the neck portion side of the main ferrite core, to be semicircular or trapezoidal in a plan view.

The supplementary ferrite core includes a step for fitting to the planar surface of the main ferrite core.

The step includes at least one portion formed to be fit to the planar surface of the main ferrite core, and a height formed the lower as it goes the farther to a rear portion.

The planar surface is formed by sintering a substantially conic main ferrite core and cutting off top and bottom portions of the sintered conic main ferrite core, or by sintering the main ferrite core directly without any additional cutting off process.

A front surface of the opening portion of the main ferrite core and a front surface of the supplementary ferrite core are aligned to the same vertical plane.

The front surface of the supplementary ferrite core is positioned at a point in rear of the front surface of the opening portion of the main ferrite core in an axis direction of the cathode ray tube, if the planar surface is sloped with respect to an axis of the cathode ray tube.

The deflection yoke further includes a supplementary holder having a through hole for inserting front portions of the opening portion of the main ferrite core and the supplementary ferrite cores, thereby receiving and holding the front portions of the opening portion of the main ferrite core and the supplementary ferrite cores.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
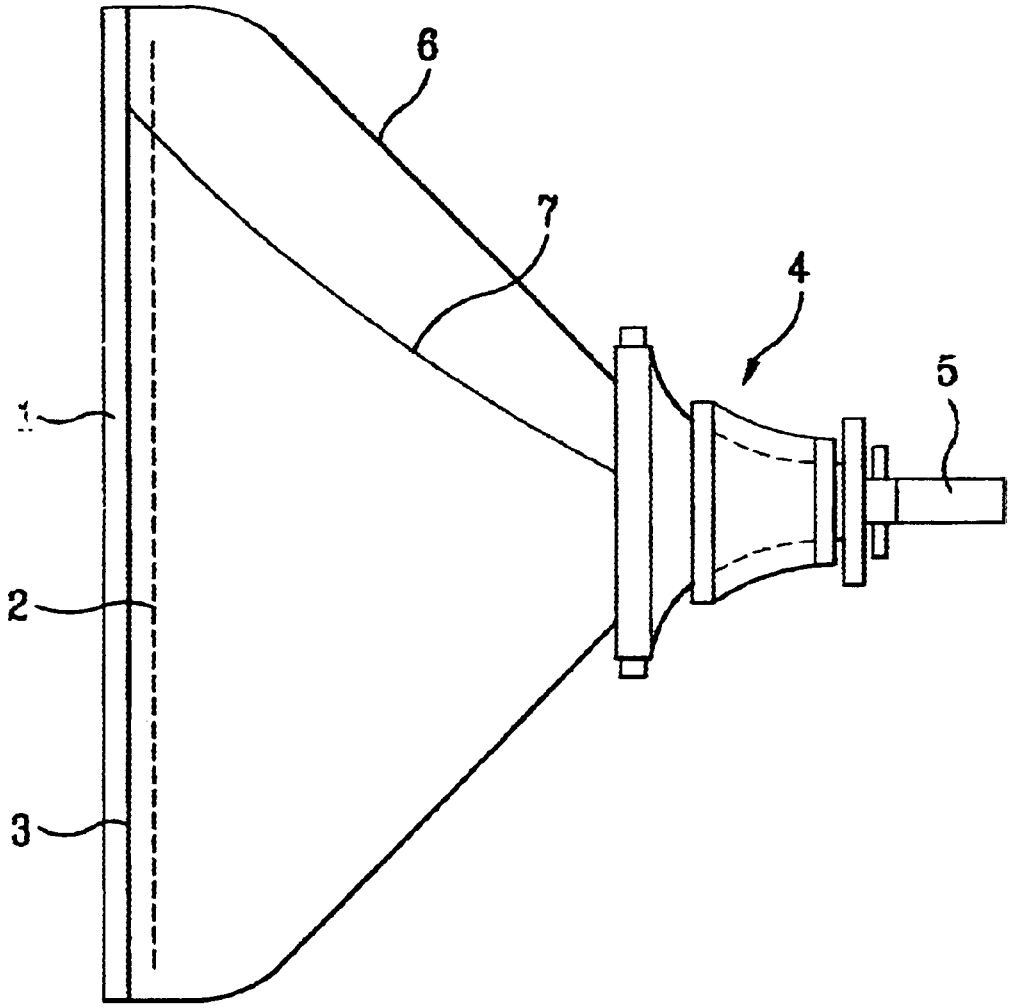
FIG. 1 PRIOR ART
FIG. 1 illustrates a side view of a related art cathode ray tube, schematically.
Figure 2A:
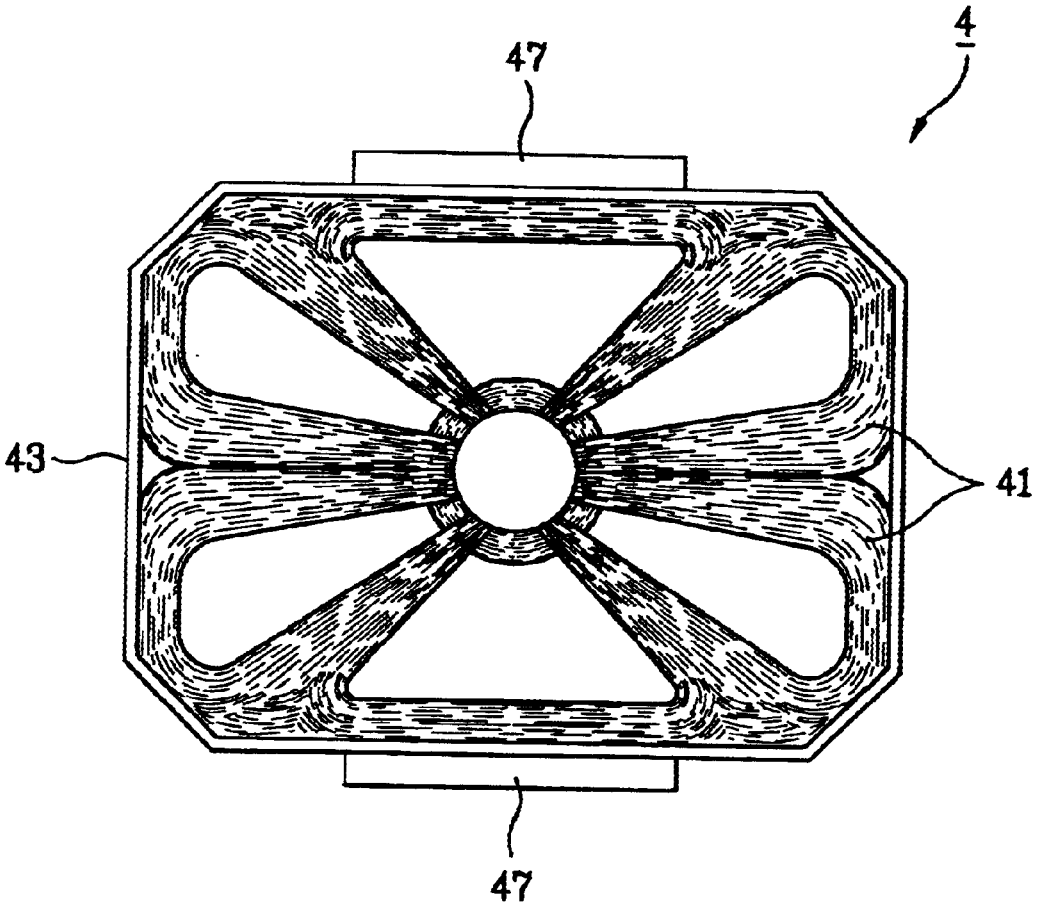
FIG. 2A PRIOR ART
FIG. 2A illustrates a front view of a RAC type deflection yoke provided to the cathode ray tube in FIG. 1.
Figure 2B:
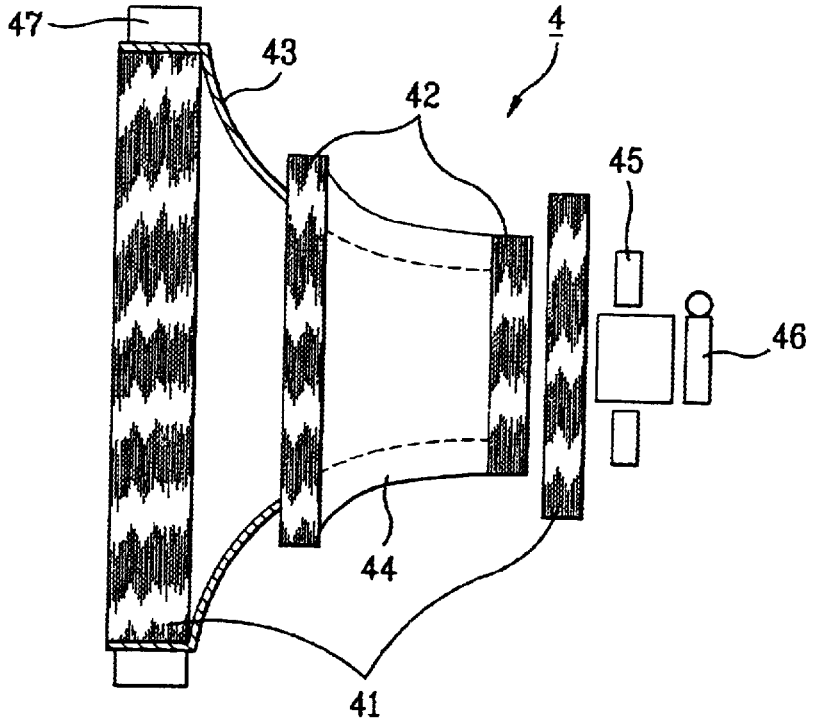
FIG. 2B PRIOR ART
FIG. 2B illustrates a side view of FIG. 2A.
Figure 3:
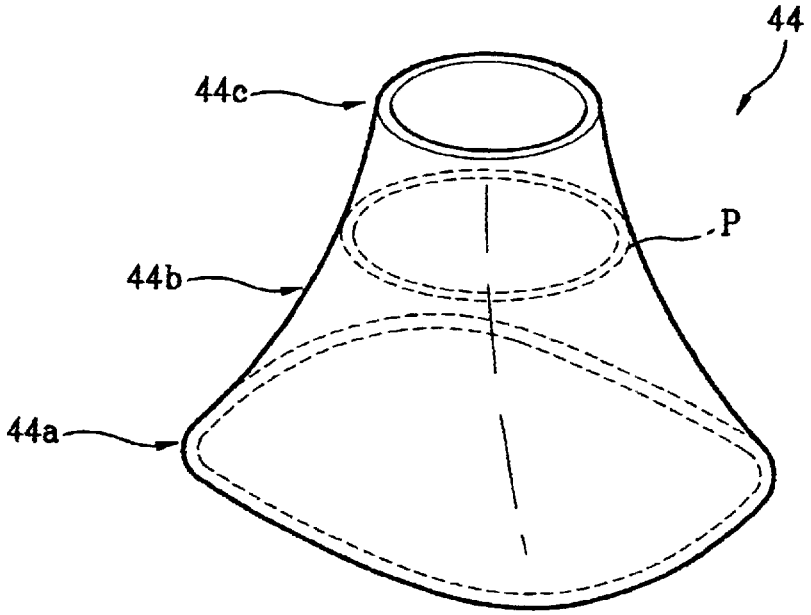
FIG. 3 PRIOR ART
FIG. 3 illustrates a perspective view of the rectangular ferrite core in FIG. 2A.
Figure 4A:
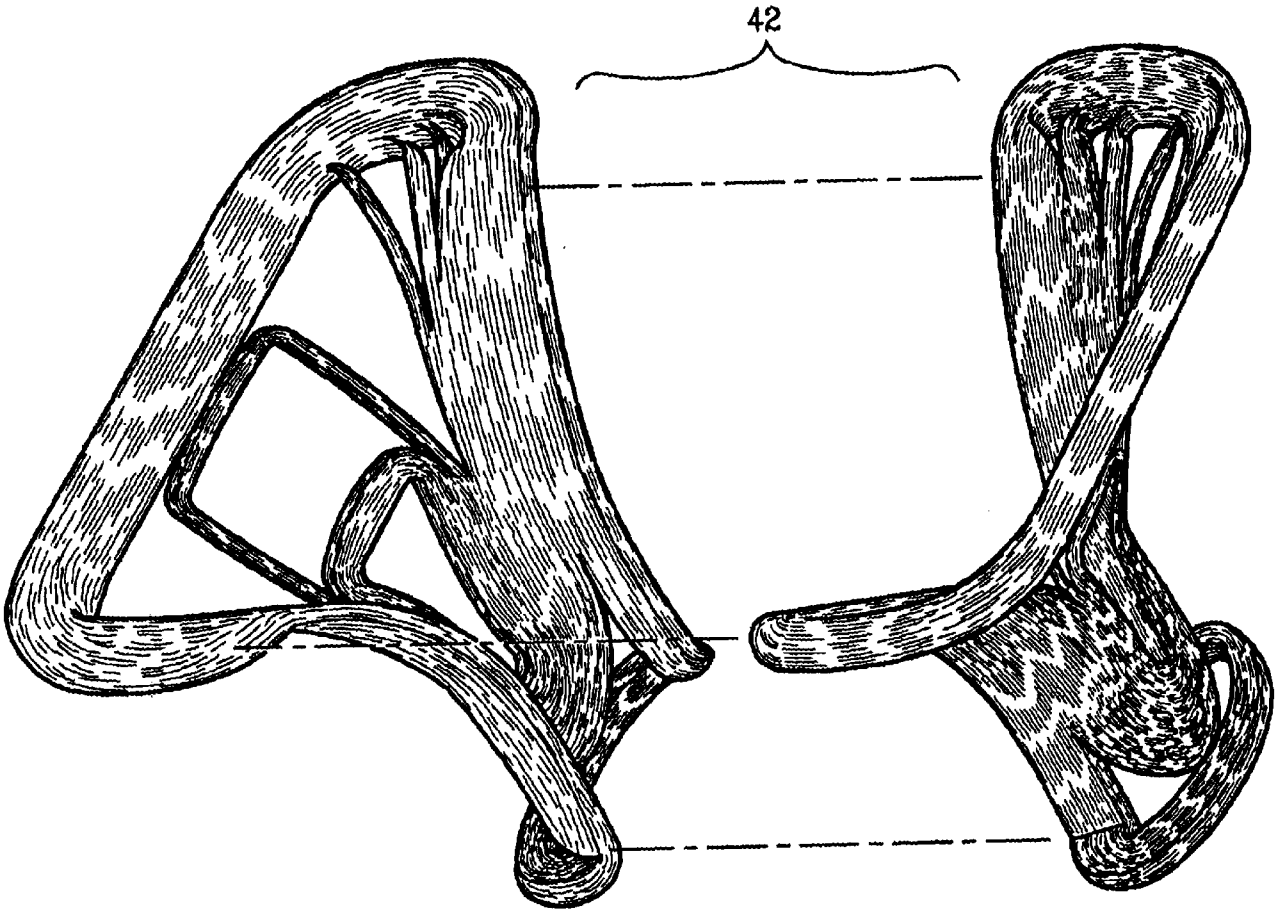
FIG. 4A PRIOR ART
FIG. 4A illustrates a disassembled perspective view of the vertical deflection coils in FIG. 2A.
Figure 4B:
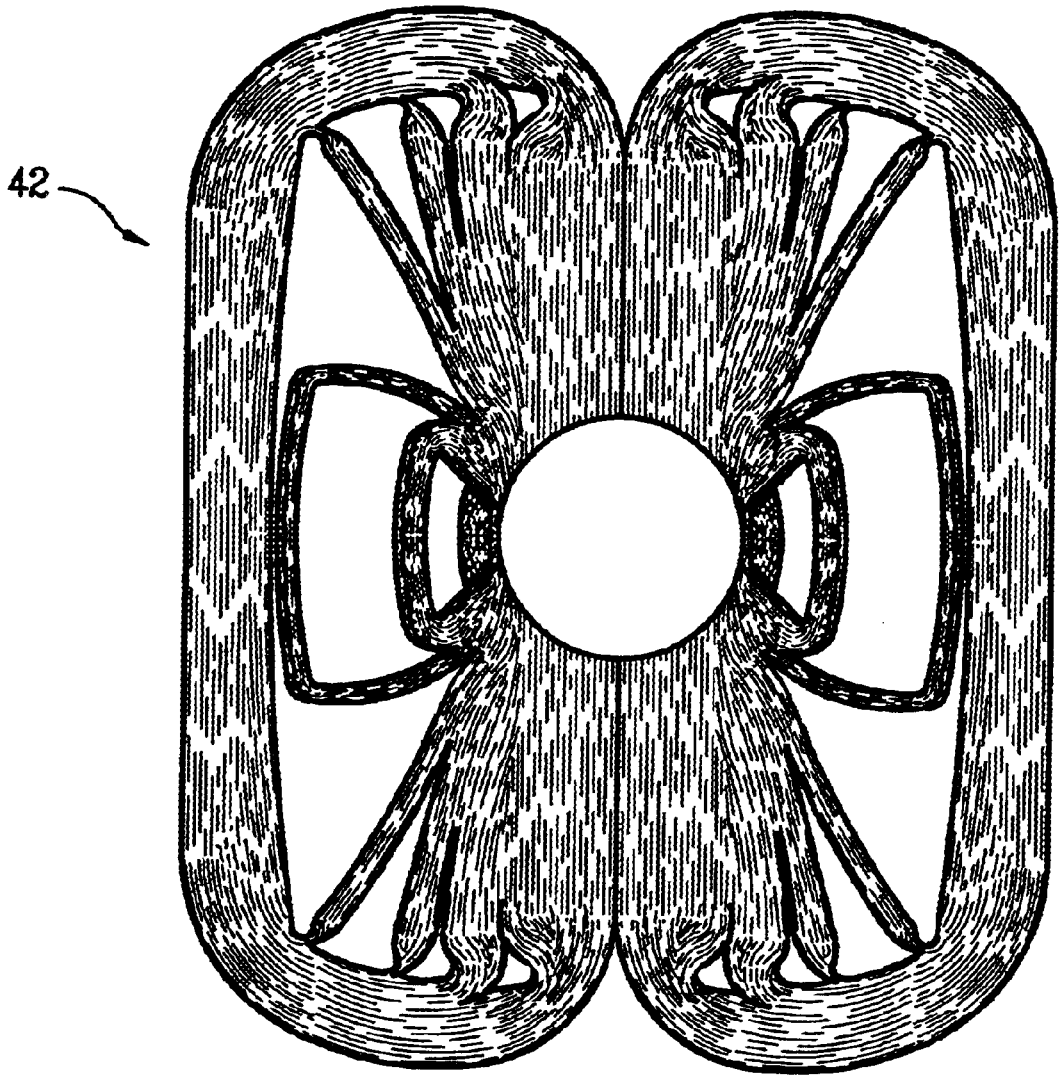
FIG. 4B PRIOR ART
FIG. 4B illustrates a front view of an assembly of the vertical deflection coils in FIG. 4A.
Figure 4C:
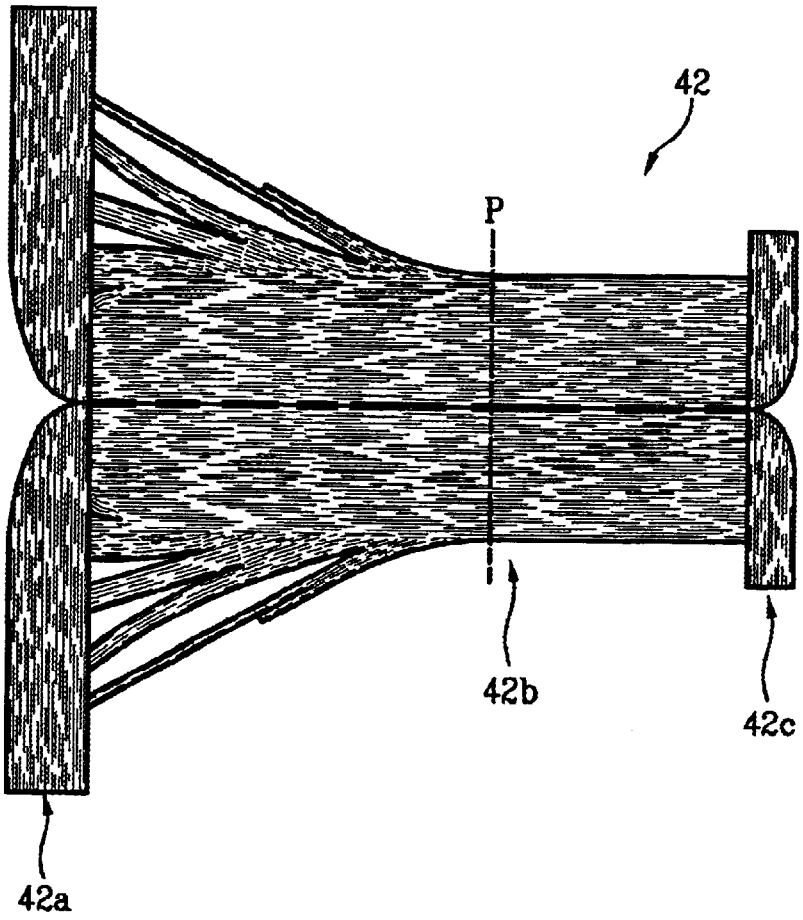
FIG. 4C PRIOR ART
FIG. 4C illustrates a side view of an assembly of the vertical deflection coils in FIG. 4A.
Figure 5A:
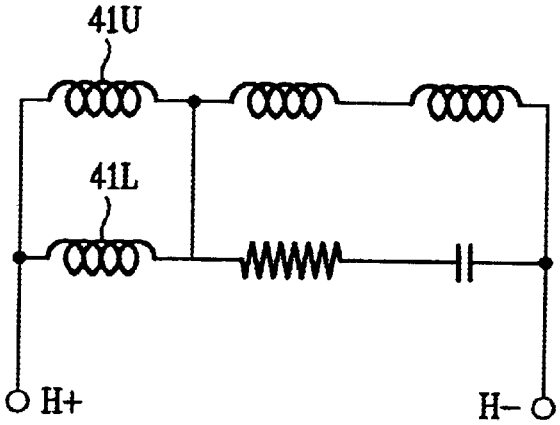
FIG. 5A PRIOR ART
FIG. 5A illustrates a horizontal deflection circuit of a related art deflection yoke.
Figure 5B:
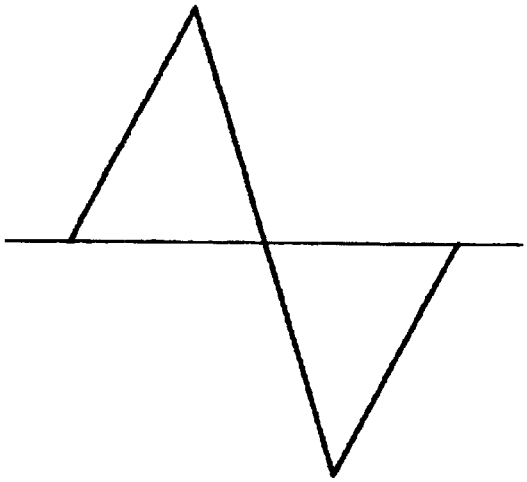
FIG. 5B PRIOR ART
FIG. 5B illustrates a wave form of a deflection current of a related art deflection yoke.
Figure 6:
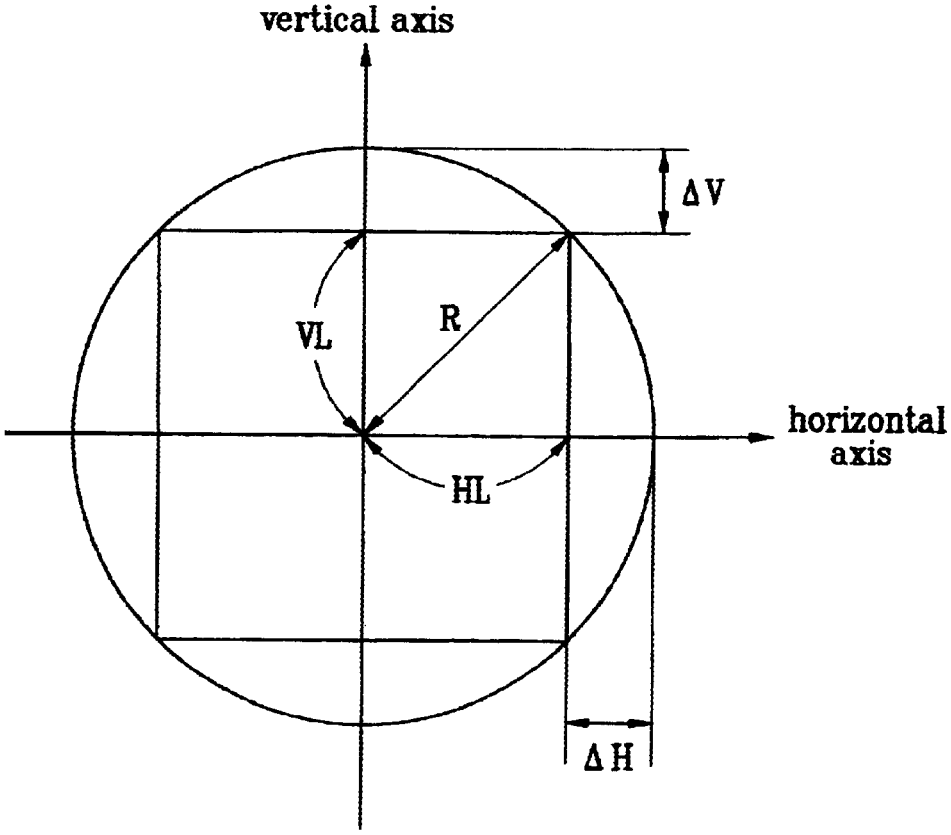
FIG. 6 PRIOR ART
FIG. 6 explains a definition of a transition ratio.
Figure 7:
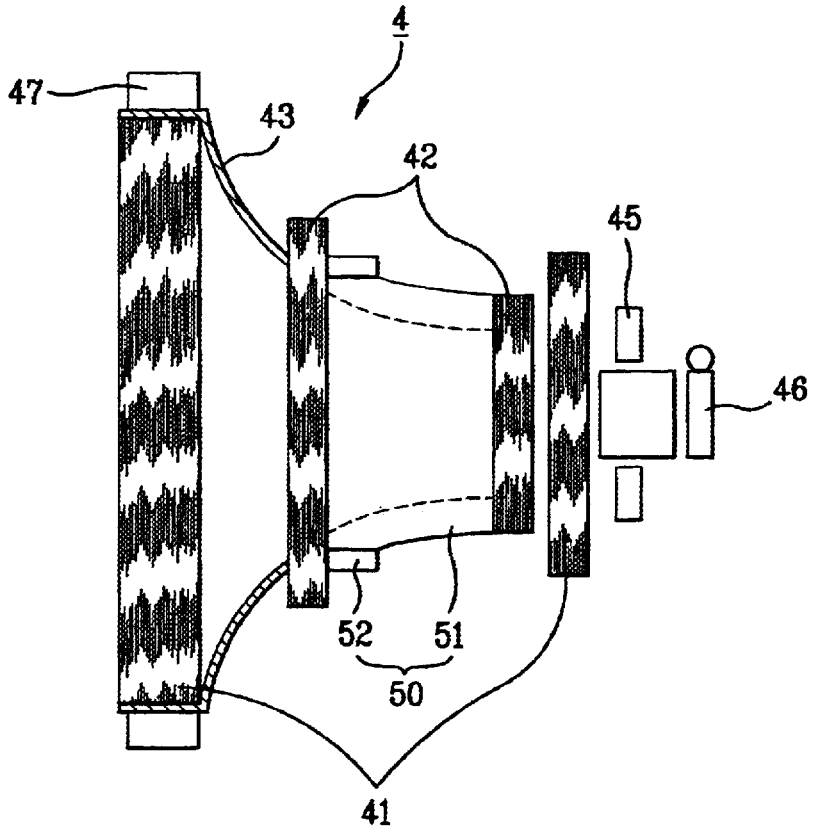
FIG. 7 illustrates a side view of a deflection yoke having a ferrite core in accordance with a first preferred embodiment of the present invention applied thereto.

Reference will now be made in detail to the preferred embodiments of the present invention, examples of which are illustrated in the accompanying drawings. FIG. 7 illustrates a side view of a deflection yoke having a ferrite core in accordance with a first preferred embodiment of the present invention applied thereto.

Referring to FIG. 7, the deflection yoke having a ferrite core in accordance with a first preferred embodiment of the present invention applied thereto includes RAC type horizontal deflection coils 41 and RAC type vertical deflection coils 42 for deflecting electron beams emitted from an electron gun in a horizontal or vertical direction, a ferrite core 50 having a main ferrite core 51 with a curved surface and supplementary ferrite cores 52 each with a flat surface for reducing a loss of a magnetic force generated at the horizontal and vertical deflection coils 41 and 42 to enhance a magnetic efficiency, and a holder 43 for fixing the horizontal deflection coil 41 and the vertical deflection coil 42 and the ferrite core 50 to preset positions, and insulating between the horizontal deflection coil 41 and the vertical deflection coil 42.

Figure 8:
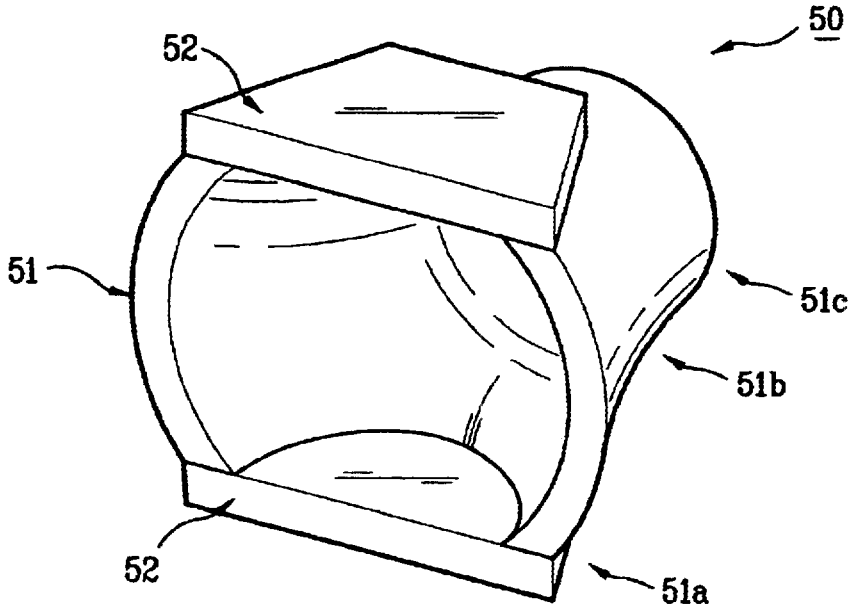
FIG. 8 illustrates a perspective view of the ferrite core in FIG. 7.
Figure 9A:
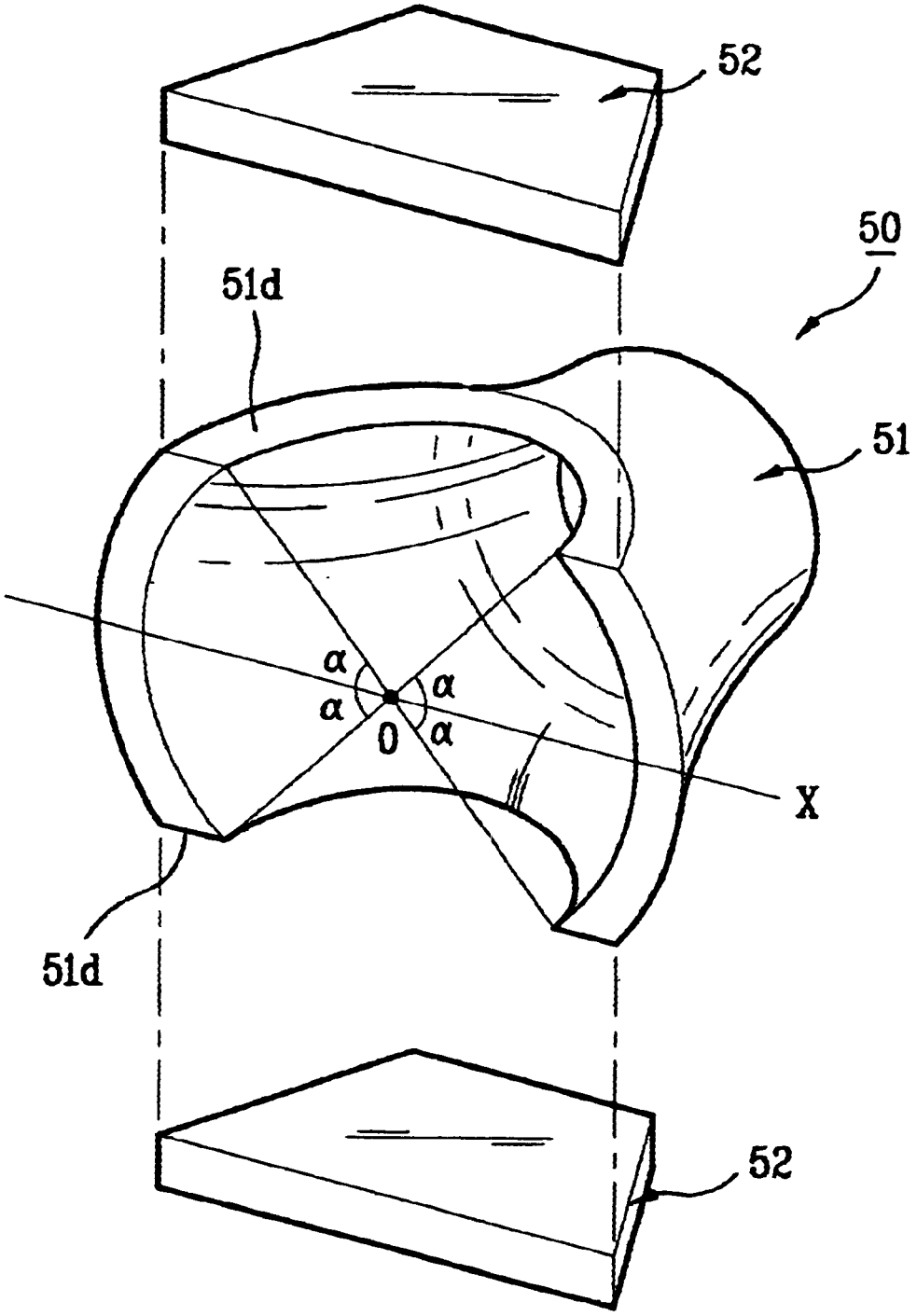
FIG. 9A illustrates a disassembled perspective view of FIG. 8.
Figure 9B:
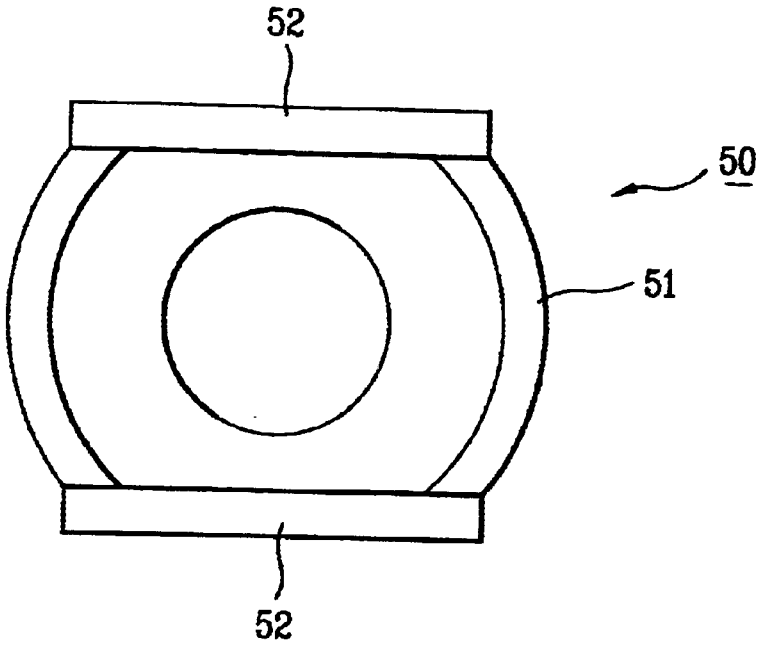
FIG. 9B illustrates a front view of FIG. 8.
Figure 9C:
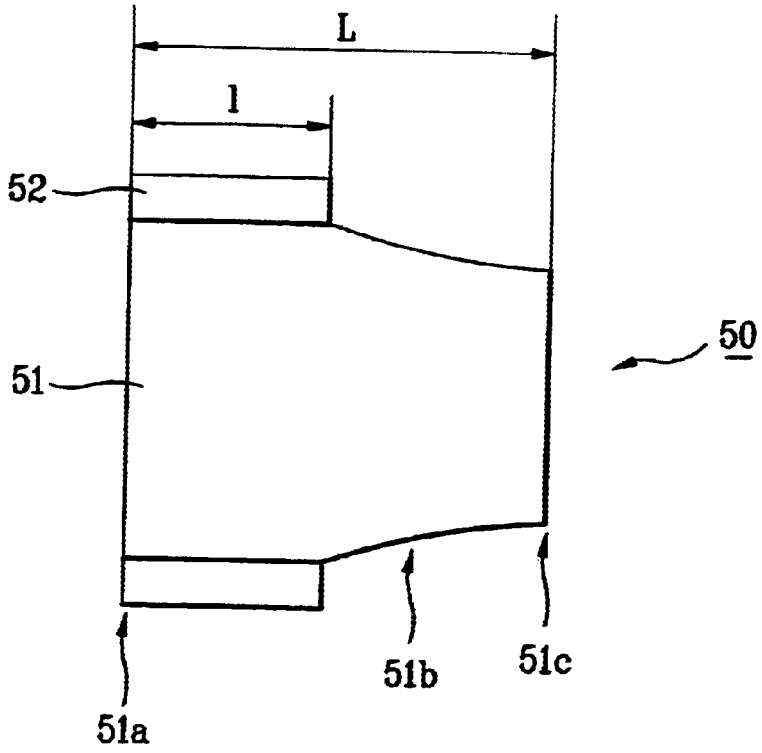
FIG. 9C illustrates a side view of FIG. 8.

FIG. 8 illustrates a perspective view of the ferrite core in FIG. 7, FIG. 9A illustrates a disassembled perspective view of FIG. 8, FIG. 9B illustrates a front view of FIG. 8, and FIG. 9C illustrates a side view of FIG. 8, referring to which the ferrite core in accordance with a first preferred embodiment of the present invention will be explained in more detail.

Referring to FIGS. 8~9C, the ferrite core 50 in accordance with a first preferred embodiment of the present invention includes a main ferrite core 51 with circular inside and outside surfaces, and supplementary cores 52 of a flat type each with a fixed thickness. The main ferrite core 51 includes an opening portion 51*a*, an intermediate portion 51*b*, and a neck portion 51*c*, with a gradually reduced circular section as it goes from the opening portion 51*a* to the neck portion 51*c*. And, though rectangular plates may also acceptable, the supplementary ferrite core 52 preferably has a trapezoidal or a semicircular form on a horizontal plane with a width which becomes the smaller as it goes the farther from a front portion to a rear portion. There are planar surfaces 51*d* on a top side and a bottom side of the opening portion 51*a* of the main ferrite core 51, to which the supplementary ferrites cores 52 are fitted. In this instance, the planar surface 51*d* is formed starting from the opening portion 51*a* of the main ferrite core 51 toward the neck portion, with a length "1" in a direction of an axis of the cathode ray tube being 5%~70% of an entire length "L" of the main ferrite core in the direction of the axis of the cathode ray tube.

The position of the planar surface 51*d* will be explained in more detail in relation to the vertical deflection coil 42. The planar surface 51*d* is formed starting from a point on the intermediate portion 51*b* of the main ferrite core opposite to a point on an outside of the vertical deflection coil 42 from which the transition from a circle to a rectangle starts. It is preferable that the planar surfaces 51*d* at the top and bottom of the opening portion side of the main ferrite core 51 are formed such that an angle '∀' between a line connecting an inner front edge of the opening portion of the planar surface 51*d* and a center '0' of the opening portion of the main ferrite core and a horizontal line 'X' passing through the center '0' of the opening portion is at least in a range of 20E~80E, and more particularly, greater than 36.7E for avoiding interference between the supplementary ferrite cores 52 fitted to the planar surfaces 51*d* of the main ferrite core 51 and the vertical deflection coils 42 which is liable to occur when the two planar surfaces 51*d* are formed too closer. In the meantime, of an entire length of the main ferrite core in an axis direction of the cathode ray tube, it is preferable that the planar surface 51*d* is formed starting from points in front of points P on an outer circumference of the main ferrite core onto which the region the transition from a circle to a rectangle of the vertical deflection coils starts are projected toward the opening portion side of the main ferrite core, and more preferably, starting from points in front of points on an outer circumference of the main ferrite core onto which points of the vertical deflection coils 42 of which transition ratio are 0.3 are projected toward the opening portion side of the main ferrite core. As described, the supplementary ferrite core 52 has a rectangular, a trapezoidal, or a semicircular form on a horizontal plane, with a thickness equal to or greater than a thickness of the main ferrite core 51 and a length equal to or greater than the length '1' in the axis direction of the cathode ray tube of the planar surface 51*d* of the main ferrite core 51. That is, the supplementary ferrite core 52 in accordance with a first preferred embodiment of the present invention may have any form, any thickness and/or any length as far as the supplementary ferrite core 52 covers an opening on an inner side of the planar surface 51*d* of the main ferrite core 51.

A process of assembly, and operation of the ferrite core in accordance with a first preferred embodiment of the present invention will be explained.

Referring to FIG. 9A, in assembly of the ferrite core, the supplementary ferrite cores 52 are accurately attached to the top and bottom planar surfaces of the main ferrite core 51 formed in parallel to the axis of the cathode ray tube from the intermediate portion 51*b* to the opening portion 51*a*, thereby completing the assembly of the ferrite core 50.

Figure 18:
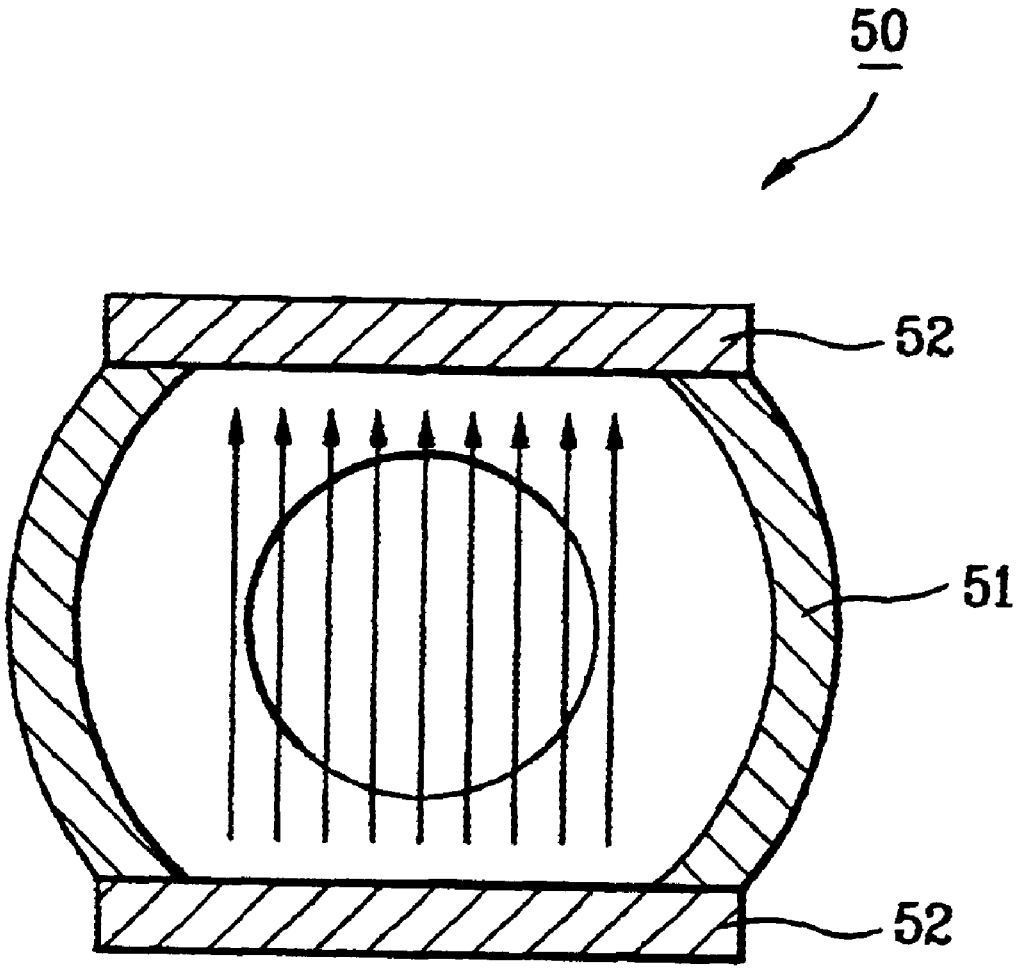
FIG. 18 illustrates a pattern of horizontal deflection magnetic flux passing through a ferrite core of the present invention.

Referring to FIG. 18, in the operation of the ferrite core 50 in accordance with a first preferred embodiment of the present invention, since a horizontal deflection magnetic field passing through the main ferrite core 51 passes through the supplementary ferrite cores 52 with the horizontal deflection magnetic field deflected along a form of the supplementary ferrite cores 52, the ferrite core 50 in accordance with a first preferred embodiment of the present invention serves to form a horizontal deflection magnetic field identical to the related art rectangular ferrite core. That is, with regard to the reduction of loss of the magnetic force of the current to the vertical deflection coils, which enhances a deflection efficiency, alike the rectangular ferrite core in the related art, the ferrite core 50 in accordance with a first preferred embodiment of the present invention can provide a deflection yoke performance in which a vertical deflection sensitivity is enhanced by approx. 20–30% compared to the circular deflection yoke because a distance between the plate formed supplementary ferrite core 52 and the vertical deflection coil 42 is closer. Moreover, while the rectangular ferrite core 44 in the related art has a great inside surface dimension deviation, that is liable to cause a convergence error and a distortion error, the ferrite core 50 in accordance with a first preferred embodiment of the present invention permits an easy formation of the ferrite core, which improves a distribution of inside surface dimensions, that permits to improve a convergence error and a distortion error compared to the present rectangular core. As has been explained, the reduction of the inside dimension deviation in the ferrite core 50 in accordance with a first preferred embodiment of the present invention compared to the rectangular ferrite core 44 in the related art permits to save materials required for fabrication of the ferrite core. And, different from the rectangular ferrite core in the related art, the circular form of the main ferrite core 51 of the ferrite core 50 in accordance with a first preferred embodiment of the present invention, which has an inside diameter identical along the cathode ray tube axis, permits to reduce an inside surface deviation below 0.2 mm in the grinding in fabrication of the ferrite core, the first preferred embodiment of the present invention permits to provide a high precision. Accordingly, not only ferrite core properties good for an HDTV can be provided, but also a yield three times larger than the related art rectangular core can be obtained.

Figure 10:
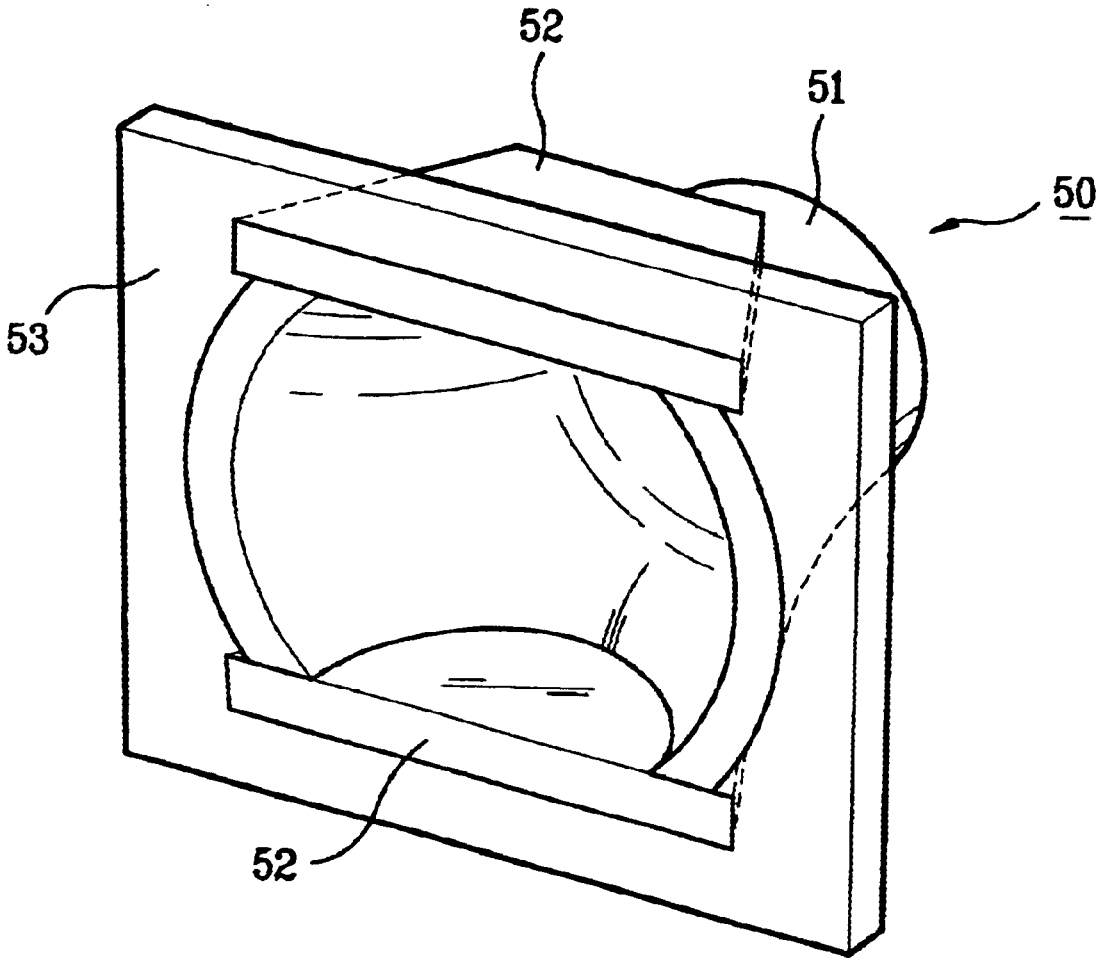
FIG. 10 illustrates a perspective view of a ferrite core in accordance with a second preferred embodiment of the present invention.
Figure 11:
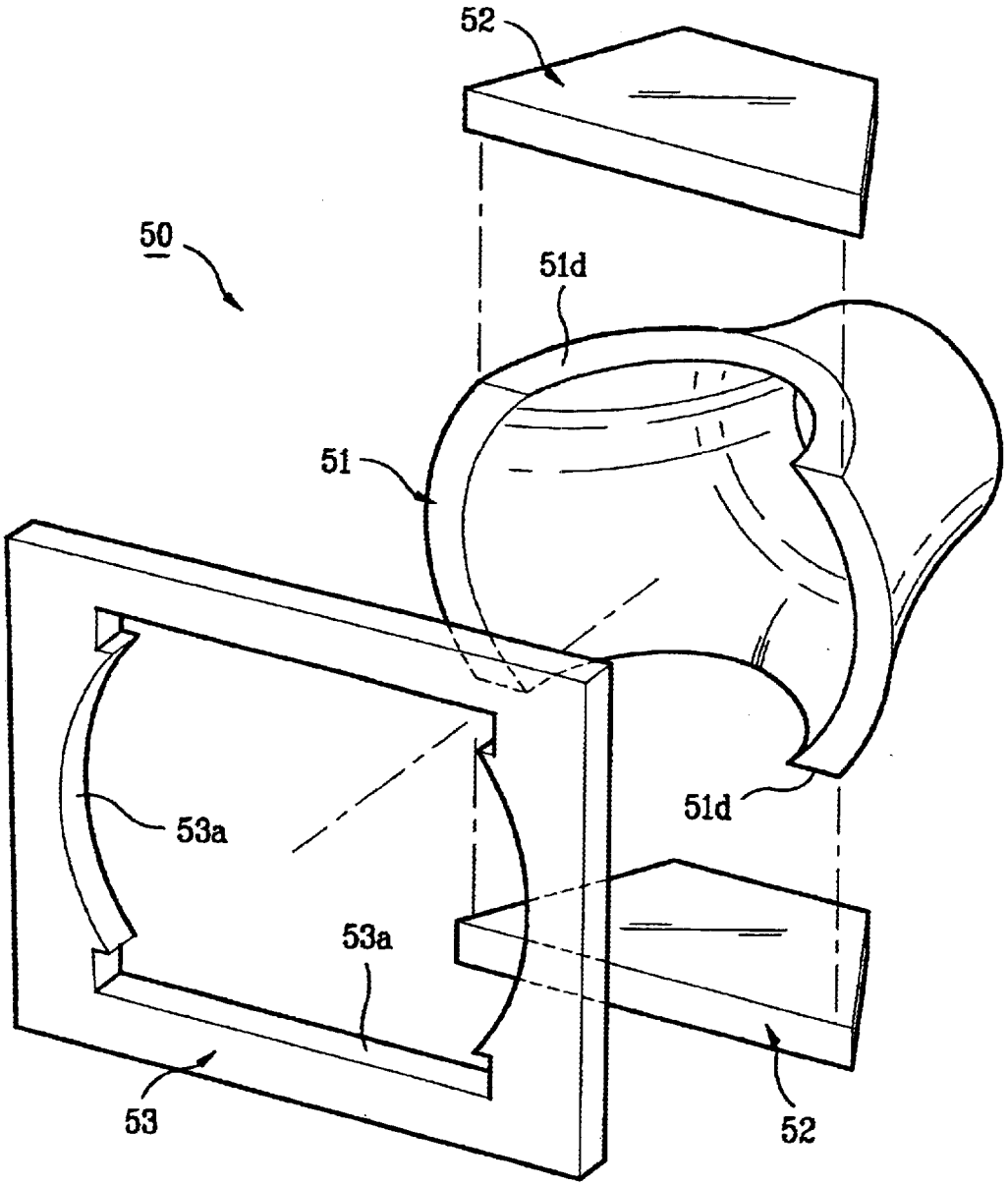
FIG. 11 illustrates a disassembled perspective view of FIG. 10.

FIG. 10 illustrates a perspective view of a ferrite core in accordance with a second preferred embodiment of the present invention, and FIG. 11 illustrates a disassembled perspective view of FIG. 10, referring to which the second embodiment of the present invention will be explained.

The ferrite core in accordance with a second preferred embodiment of the present invention has a system identical to the system of the foregoing first embodiment ferrite core in overall, except that the second embodiment ferrite core further includes a supplementary holder 53 for supporting the supplementary ferrite cores 52, to fix the supplementary cores 52 to top and bottom of the main ferrite core 51, more positively. The supplementary holder 53 is a plate having a through hole 53*a* formed therein, in which all edges at opening portion side of the main ferrite core 51 and forward side of the supplementary ferrite cores 52 are inserted. Therefore, by inserting the main ferrite core 51 into a central portion of the through hole 53*a* in the supplementary holder 53 at first, and by inserting the supplementary ferrite cores 52 into remained spaces in a periphery of the through hole 53*a* at top and bottom of the main ferrite core, the main ferrite core 51 and the supplementary ferrite cores 52 can be coupled together more firmly with easy. According to this, the ferrite core 50 in accordance with a second preferred embodiment of the present invention, not only can form a more stable deflection magnetic field, but also can protect the deflection yoke from impact, such as one during transportation and other internal and external impacts, after a completed deflection yoke is built in a product.

Figure 12:
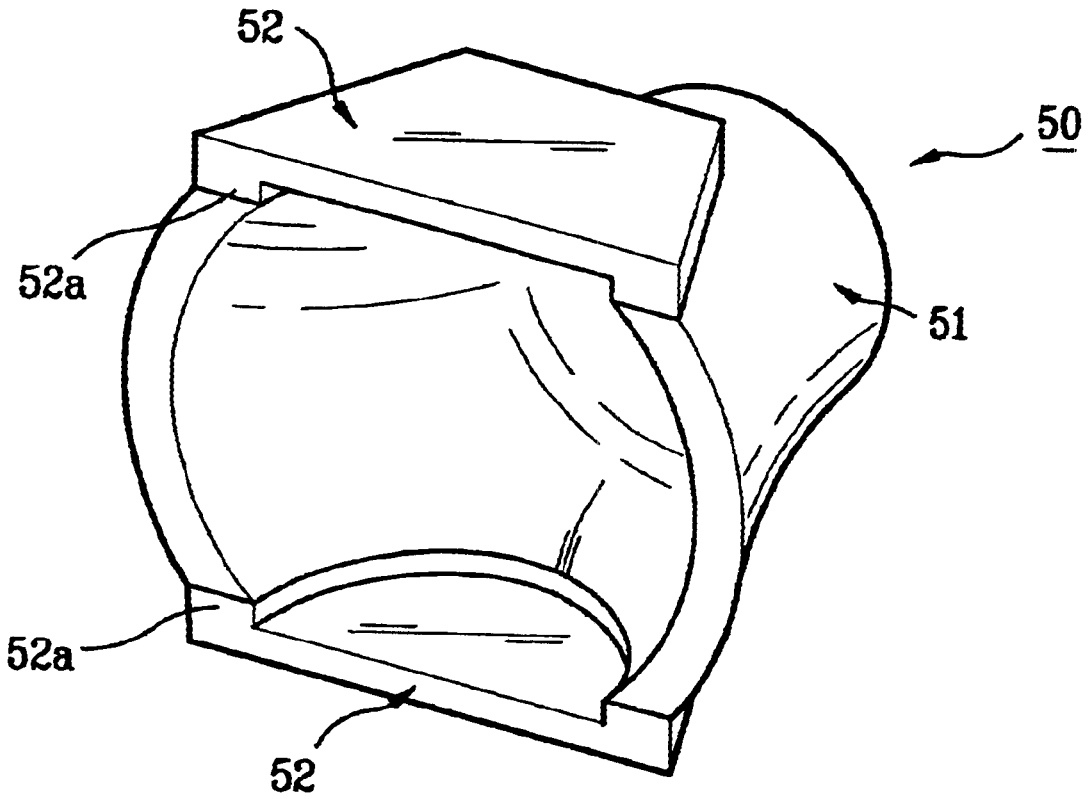
FIG. 12 illustrates a perspective view of a ferrite core in accordance with a third preferred embodiment of the present invention.
Figure 13A:
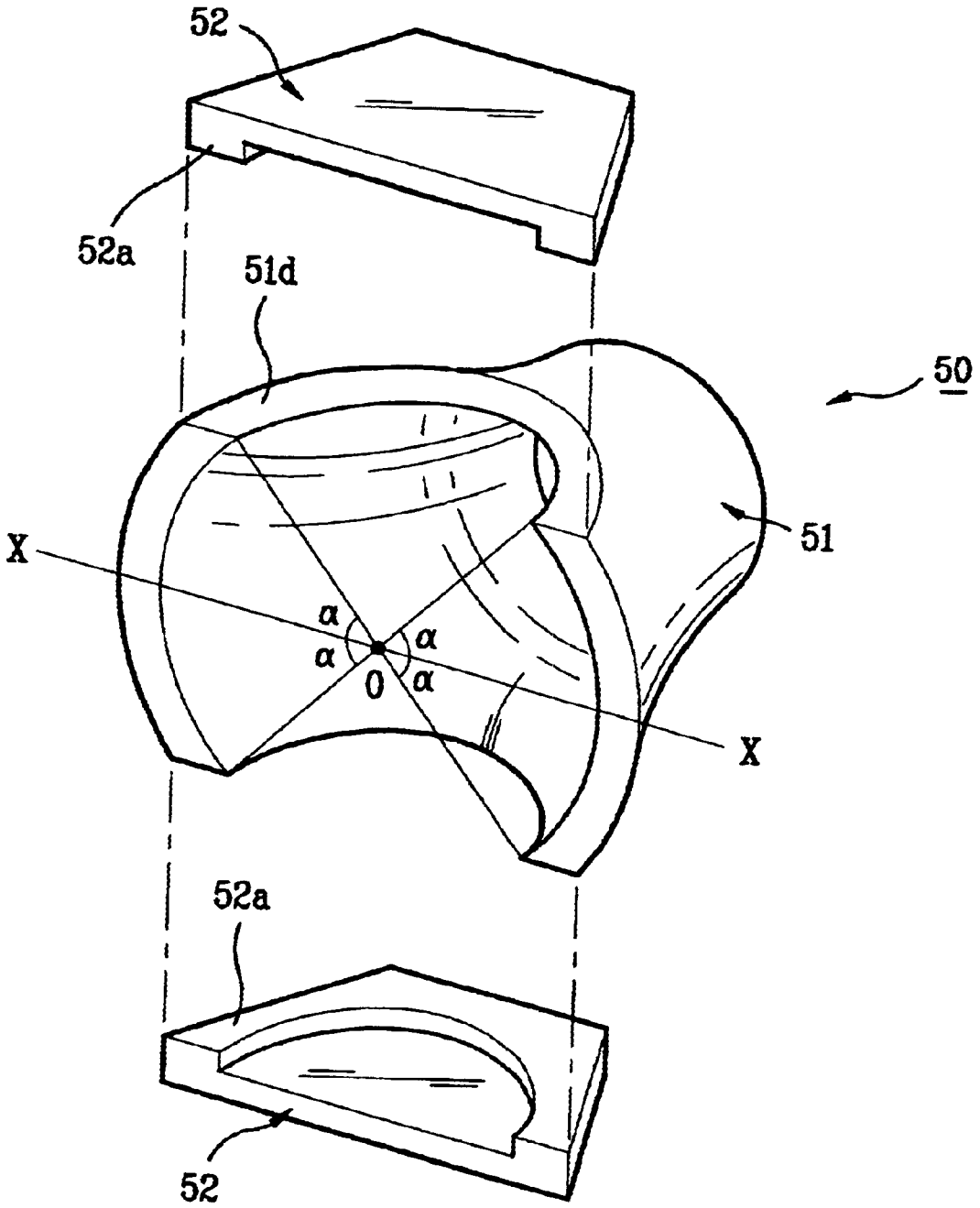
FIG. 13A illustrates a disassembled perspective view of FIG. 12.
Figure 13B:
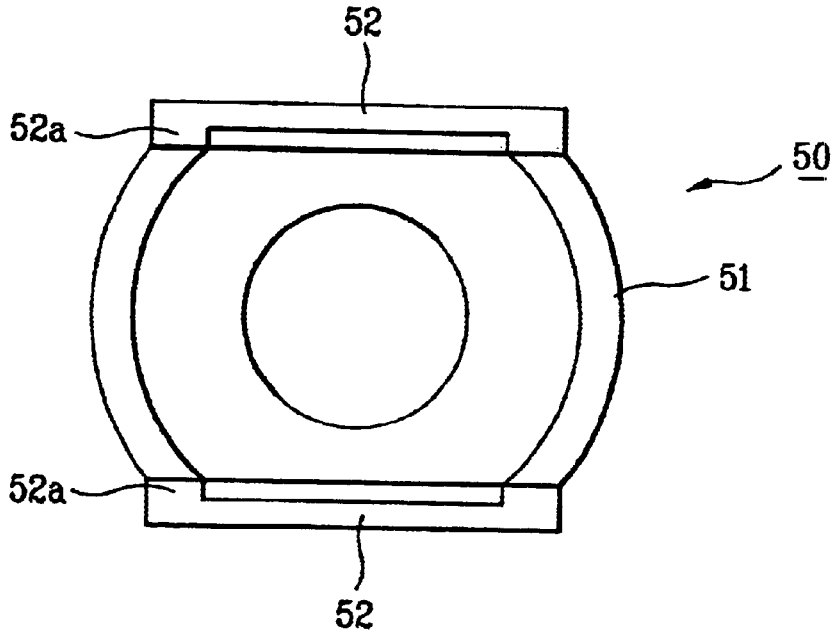
FIG. 13B illustrates a front view of FIG. 12.
Figure 13C:
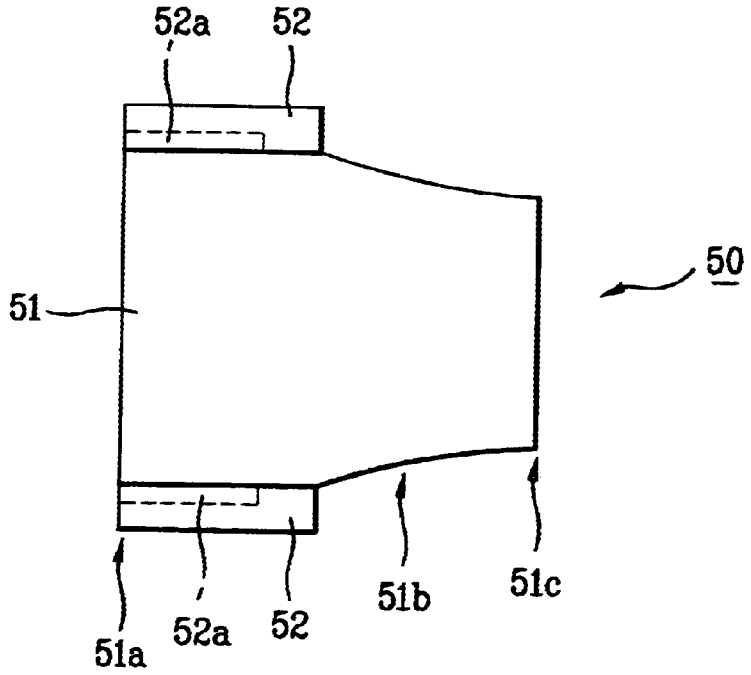
FIG. 13C illustrates a side view of FIG. 12.

FIG. 12 illustrates a perspective view of a ferrite core in accordance with a third preferred embodiment of the present invention, FIG. 13A illustrates a disassembled perspective view of FIG. 12, FIG. 13B illustrates a front view of FIG. 12, and FIG. 13C illustrates a side view of FIG. 12, referring to which the third embodiment of the present invention will be explained.

The ferrite core in accordance with a third preferred embodiment of the present invention has a system similar to the system of the foregoing first embodiment ferrite core in overall, except that the third embodiment ferrite core further includes a step 52*a* formed on an inner side of the supplementary ferrite core 52 to fit to the planar surface 51*d* of the main ferrite core. The step 52*a* on the inner side of the supplementary ferrite core 52 permits the planar surface 51*d* formed closer to the center '0' of the main ferrite core in a vertical direction as much as the step 52*a*. Accordingly, an area of the supplementary core 52 fitted to the planar surface 51*d* can be increased, to increase an influential area of the supplementary core 52, that enhances a deflection efficiency of the ferrite core 50, thereby reducing a deflection power applied to the deflection yoke. In more detail, there has been a difficulty in formation of the planar surface 51*d* closer to the center '0' of the main ferrite core in a vertical direction for enlarging a sectional area of the main ferrite core 51 in the first embodiment, because the closer planar surface 51*d* may possibly lead the supplementary ferrite core 52 to interfere with the vertical deflection coil 42. However, even if the planar surface 51*d* is formed closer to the center '0' of the ferrite core 51 in the vertical direction in the third embodiment of the present invention, the step 52*a* on the inner side of the supplementary ferrite core 52 increases a distance from a planar portion of the supplementary ferrite core 52 to the center '0' in a vertical direction to a position where no interference with the vertical deflection coil is occurred. Accordingly, the third embodiment ferrite core of the present invention can reduce the deflection power to be applied to the deflection yoke more effectively as the third embodiment ferrite core of the present invention can enhance the deflection efficiency of the ferrite core 50 by forming the planar surface 51*d* of the main ferrite core 51 closer to the center '0' of the main ferrite core in the vertical direction, to increase an area of the planar surface 51*d*, which increases a working area of the supplementary ferrite core 52. It is preferable that the planar surface 51*d* of the main ferrite core 51 is formed at a position where an angle '∀' between a line connecting an inner edge of the opening portion of the planar surface 51*d* and the center '0' of the opening portion of the main ferrite core and the horizontal line 'X' passing through the center '0' of the opening portion is greater than 25E. Alike the first embodiment, the supplementary ferrite core 52 may have a variety of forms, such as a rectangular, a trapezoidal, or a semicircular form on a horizontal plane. Thus, the third embodiment ferrite core of the present invention can enhance a deflection efficiency and bring the ferrite core 50 and the holder 43 into a closer coupling.

Figure 14:
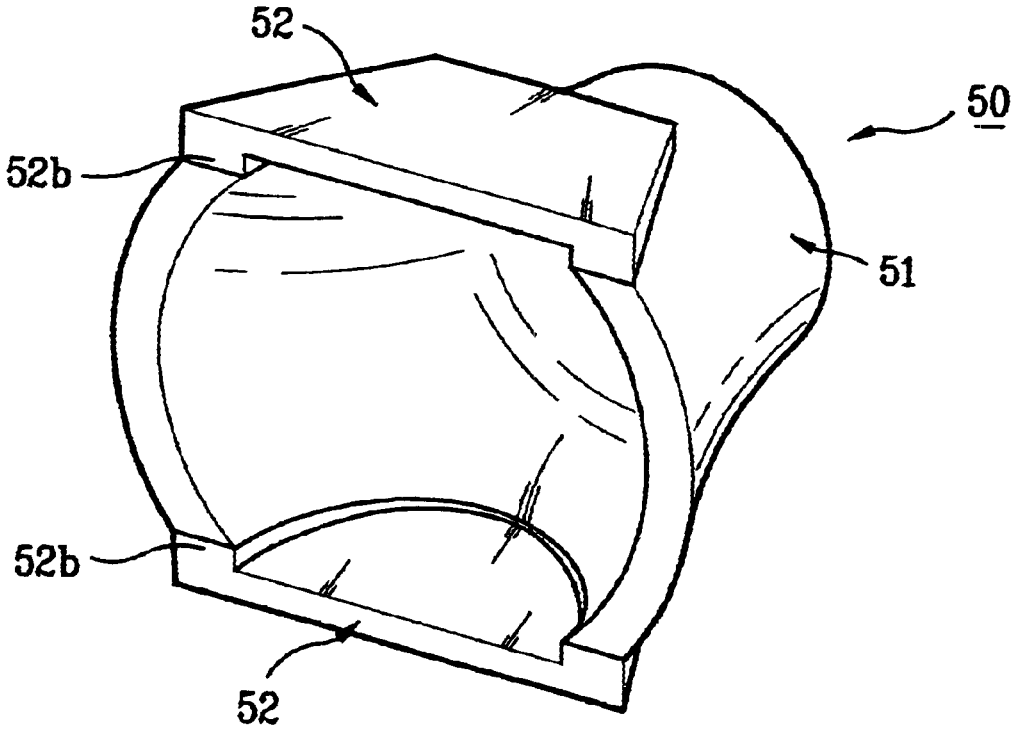
FIG. 14 illustrates a perspective view of a ferrite core in accordance with a fourth preferred embodiment of the present invention.
Figure 15A:
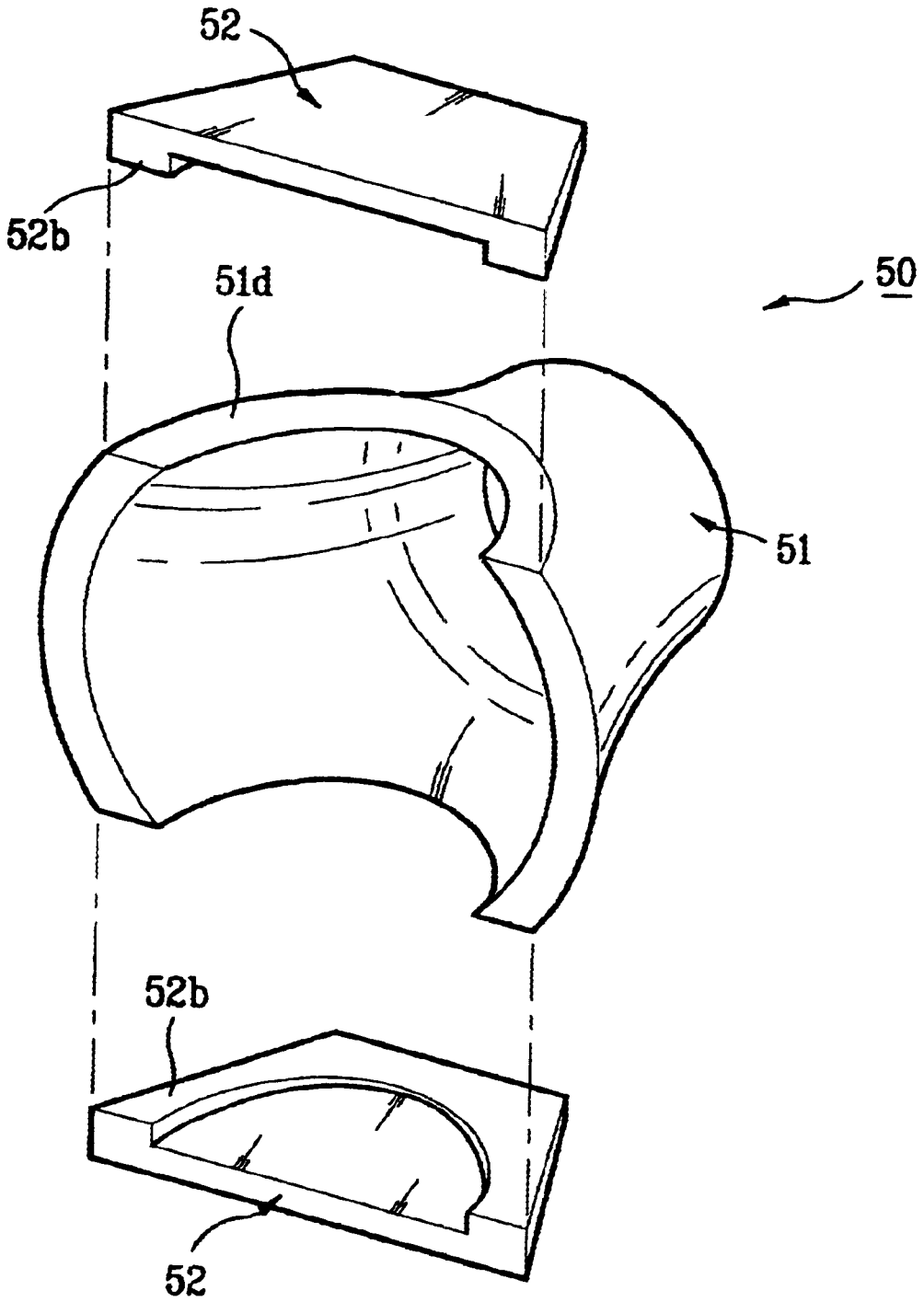
FIG. 15A illustrates a disassembled perspective view of FIG. 14.
Figure 15B:
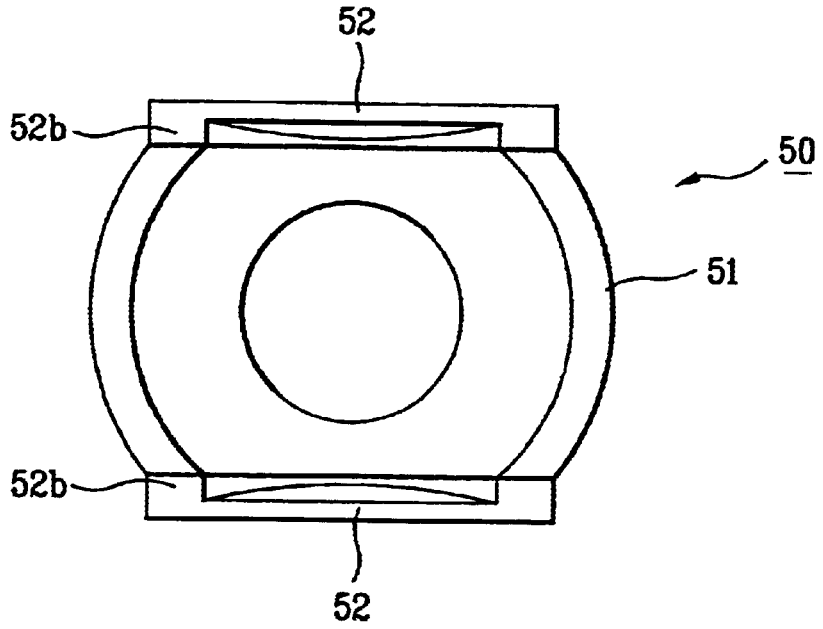
FIG. 15B illustrates a front view of FIG. 14.
Figure 15C:
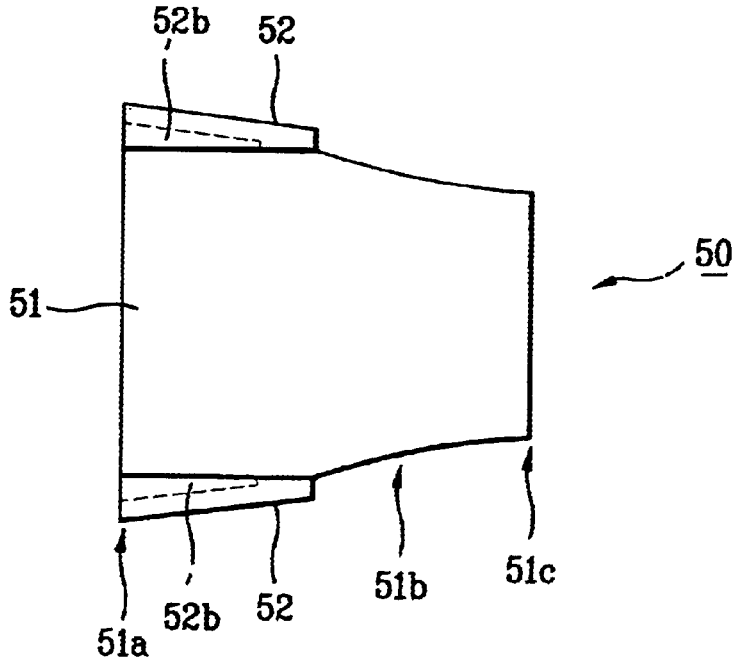
FIG. 15C illustrates a side view of FIG. 14.

FIG. 14 illustrates a perspective view of a ferrite core in accordance with a fourth preferred embodiment of the present invention, FIG. 15A illustrates a disassembled perspective view of FIG. 14, FIG. 15B illustrates a front view of FIG. 14, and FIG. 15C illustrates a side view of FIG. 14, referring to which the ferrite core in accordance with a fourth embodiment of the present invention will be explained.

The ferrite core in accordance with a fourth preferred embodiment of the present invention has a system substantially identical to the system of any one of the foregoing embodiments, and particularly, the main ferrite core 51 has a system identical to the foregoing first to third embodiments, except that, alike the third embodiment, the fourth embodiment ferrite core further includes a step 52*b* formed on an inner side of the supplementary ferrite core 52 to fit to the planar surface 51*d* of the main ferrite core, but with a height of the step 52*b* which becomes the lower as it goes from a front of the supplementary ferrite core 52 to a rear thereof (that is, as it goes the farther in the axis direction of the cathode ray tube). The fourth embodiment ferrite core of the present invention, with the sloped step 52*b* of the supplementary ferrite core 52, can enhance coupling with the holder 43 as the interference with the vertical deflection coil 42 is eliminated, and permits to obtain the same effect with the third embodiment as the working area of the supplementary ferrite core 52 is increased.

Figure 16:
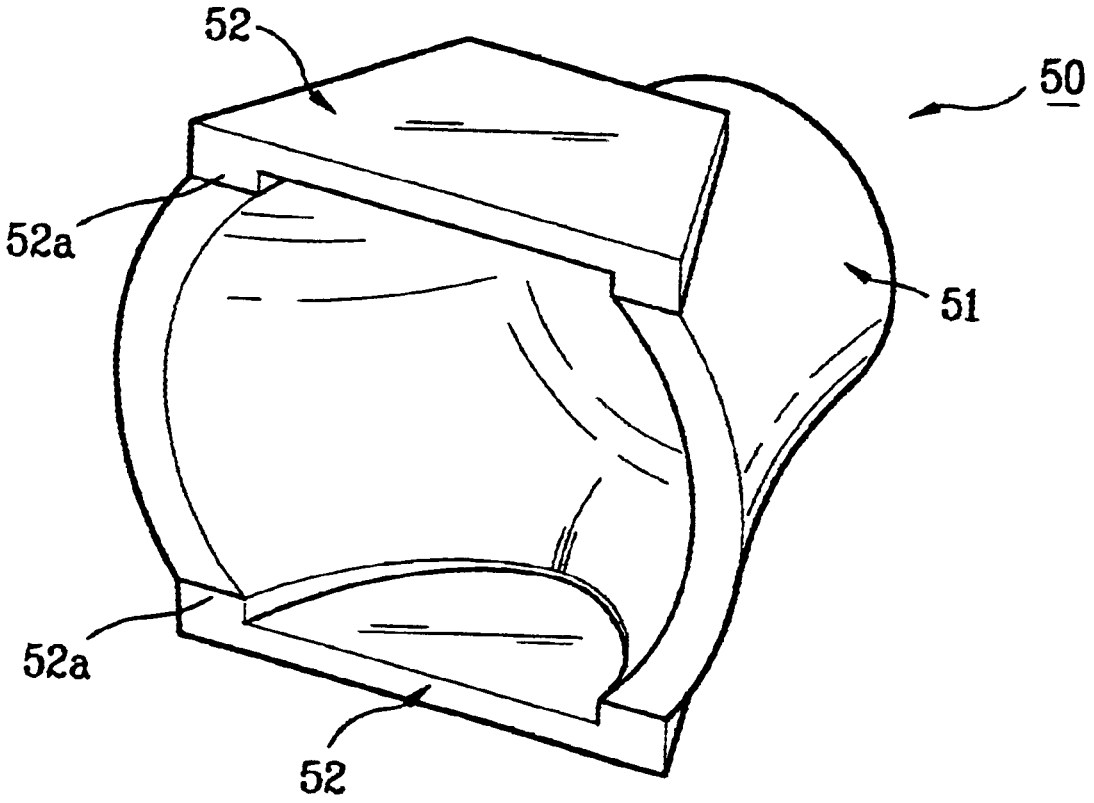
FIG. 16 illustrates a perspective view of a ferrite core in accordance with a fifth preferred embodiment of the present invention.
Figure 17A:
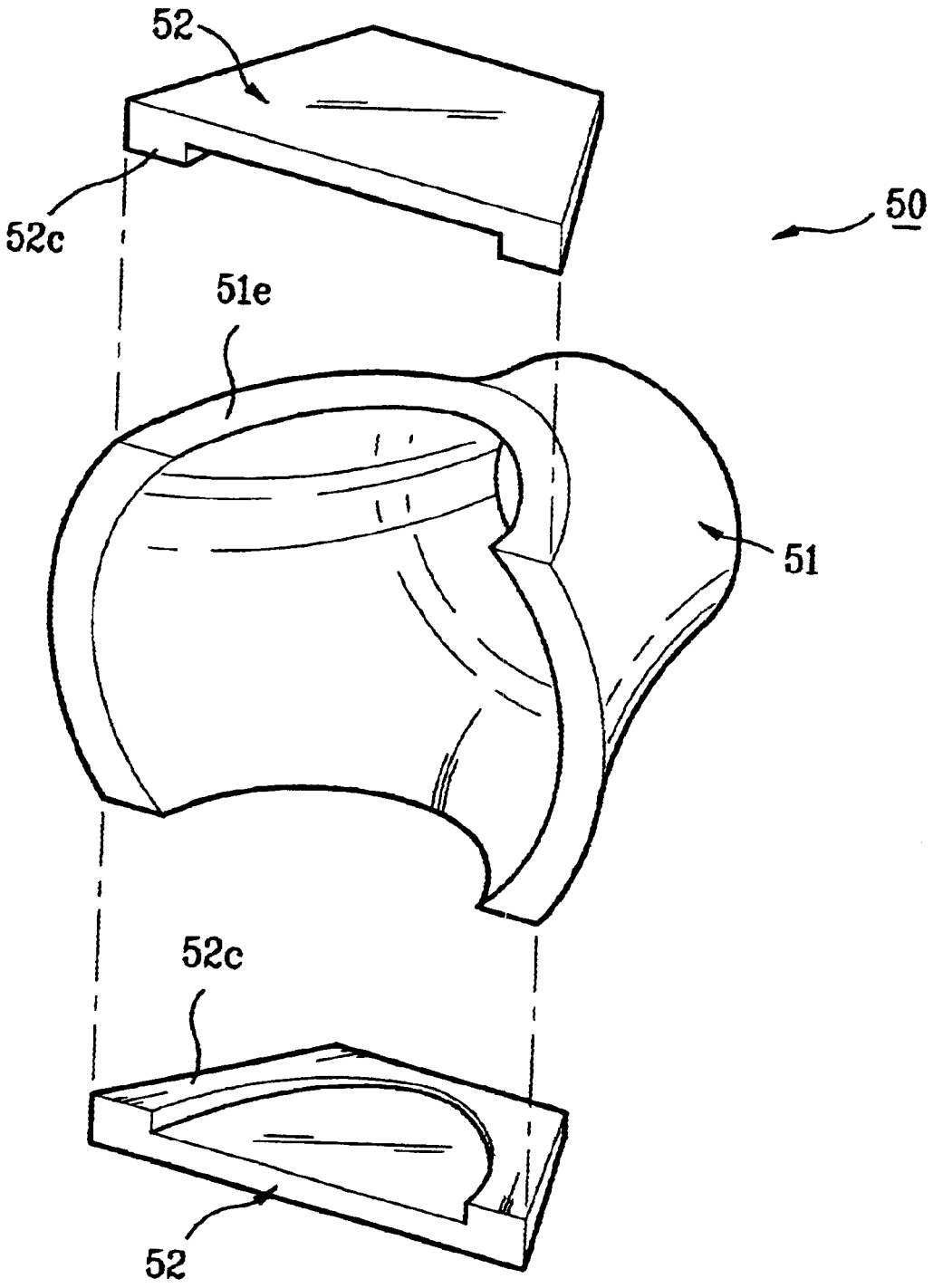
FIG. 17A illustrates a disassembled perspective view of FIG. 16.
Figure 17B:
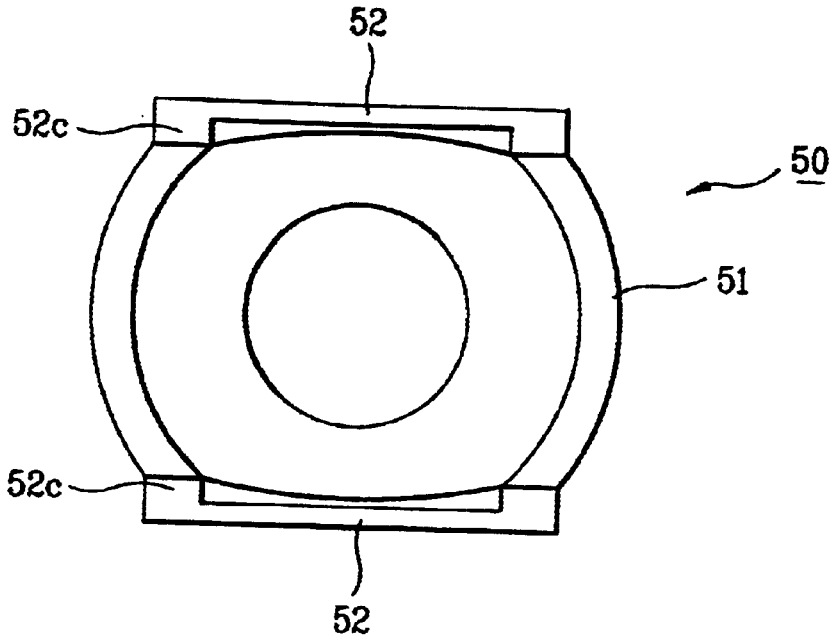
FIG. 17B illustrates a front view of FIG. 16.
Figure 17C:
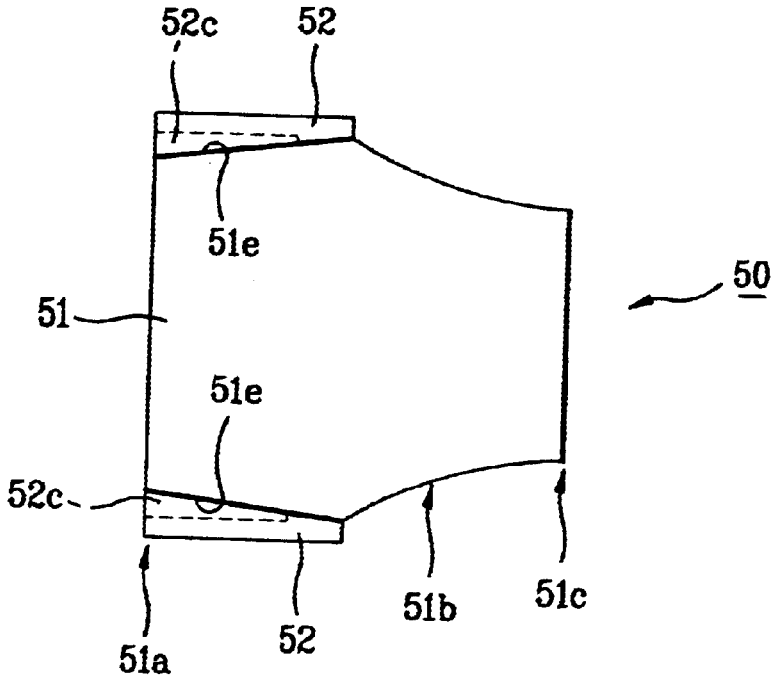
FIG. 17C illustrates a side view of FIG. 16.

FIG. 16 illustrates a perspective view of a ferrite core in accordance with a fifth preferred embodiment of the present invention, FIG. 17A illustrates a disassembled perspective view of FIG. 16, FIG. 17B illustrates a front view of FIG. 16, and FIG. 17C illustrates a side view of FIG. 16, referring to which the fifth embodiment ferrite core of the present invention will be explained.

The ferrite core in accordance with a fifth preferred embodiment of the present invention has a system similar to the system of the first, third or fourth embodiment, except that a planar surfaces 51*e* at top and bottom of the opening portion 51*a* side of the main ferrite core 51 are sloped. The planar surface 51*e* is sloped with respect to the axis of the cathode ray tube such that a front portion of the planar surface 51*e* is positioned lower than a rear portion thereof. And, a step 52*c* on the supplementary ferrite core 52 permits the planar surface 51*e* formed to be closer to a center '0' of the main ferrite core in a vertical direction as much as a height of the step 52*c*. When it is assumed that lengths of the planar surfaces in the axis of the cathode ray tube formed on the main ferrite core 51 are identical, since the sloped planar surface 51*e* leads to form an area of the planar surface 51*e* larger than the same in the aforementioned first to fourth embodiment, to increase a coupling area with the supplementary ferrite core 2, a working force of the supplementary ferrite core 52 can be enhanced. Thus, the fifth embodiment ferrite core of the present invention can enhance a deflection efficiency to reduce a deflection power provided to the deflection yoke owing to an increased working force of the supplementary ferrite core 52 caused by increased areas of the planar surface 51 e and the supplementary ferrite core 52 coupled to the planar surface 51*e*. In the meantime, since the slope of the planar surface 51*e* with respect to the axis direction of the cathode ray tube places the planar surface 51*e* closer to the center '0' of the main ferrite core 51 in the vertical direction, occurrence of interference between the supplementary ferrite core and the vertical deflection coil is liable. In this instance, the occurrence of interference between the supplementary ferrite core and the vertical deflection coil 42 can be resolved by fitting the supplementary ferrite core 52 to the planar surface 51*e* of the main ferrite core at a position moved in a rear direction from the opening portion of the main ferrite core within a range which does not affect the deflection efficiency.

In the meantime, it is apparent that the supplementary holder 53 in the second embodiment may also be applied to the third to fifth embodiment, for a firm coupling between the main ferrite core 51 and the supplementary ferrite cores 52. Of course, the through hole 53*a* in the supplementary holder 53 should be vary with forms of the main ferrite core and the supplementary ferrite core. And, referring to FIG. 18, in the operation of the ferrite core 50 in accordance with the second to fifth preferred embodiment of the present invention too, since a horizontal deflection magnetic field passing through the main ferrite core 51 passes through the supplementary ferrite cores 52 with the horizontal deflection magnetic field deflected along a form of the supplementary ferrite cores 52, the ferrite core 50 in accordance with the first to fifth preferred embodiment of the present invention serves to form a horizontal deflection magnetic field identical to the related art rectangular ferrite core. And, of course, the second to fifth embodiment ferrite core 50 of the present invention can also improve the convergence error and the distortion error caused by a dimensional deviation of an inside surface, and save materials required for fabrication of the ferrite core. And, of course, the second to fifth embodiment ferrite core 50 of the present invention can also enhance an accuracy of the ferrite core 51 by reducing an inside surface deviation to be below 0.2 mm by an inside surface grinding during fabrication of the ferrite core because inside and outside surfaces of the main ferrite core 51 are circular, that is easy to grind. The planar surfaces in respective embodiments of the present invention may be formed by sintering a substantially conic main ferrite core and cutting off top and bottom portions of the sintered conic main ferrite core, or by directly sintering the main ferrite core without any additional cutting off process.

Because the ferrite core of the present invention has a main ferrite core of which inside and outside surfaces are circular regardless of positions of the main ferrite core in a direction of axis of the cathode ray tube and supplementary cores each having a constant thickness and a variety of forms, the ferrite core of the present invention has the following advantages.

First, while the related art ferrite core, with its circular neck portion, a rectangular opening portion, and an intermediate portion with regions of transition from a circle to a rectangle, leads an inside surface grinding of the ferrite core difficult, to have a smaller yield as an inside surface distribution is great owing to difference of an inside surface radius in the horizontal direction and the vertical direction, and to have a high material cost and production cost, the ferrite core of the present invention has no such problems. That is, the ferrite core of the present invention, with its circular inside surface, permits, not only reduction of a distribution of an inside surface dimensions by more than ½ of the rectangular ferrite core, but also to increase a production yield as the grinding for the inside surface of the core, which should be accurate, can be carried out with easy, to reduce a material cost by more than ⅓.

Second, the ferrite core of the present invention can meet requirements for a deflection yoke for use in an HDTV in which the convergence error and the distortion error in the related art deflection yoke are improved significantly.

Third, since the step on the supplementary ferrite core fitted to the planar surfaces of the main ferrite core permits to increase a working area of the supplementary ferrite core, to enhance a deflection efficiency of the ferrite core, a deflection power provided to the deflection yoke can be reduced.

Fourth, the step on an inner side of the supplementary ferrite core, with a consequent short distance from the planar surface of the main ferrite core to the center '0' of the main ferrite core in a vertical direction, enhances a deflection efficiency of the ferrite core.

Fifth, the supplementary holder provided additionally permits, not only an easy assembly of the main ferrite core and the supplementary ferrite cores, but also a firm coupling of the main ferrite core and the supplementary ferrite cores.

It will be apparent to those skilled in the art that various modifications and variations can be made in the deflection yoke for a cathode ray tube of the present invention without departing from the spirit or scope of the invention. Thus, it is intended that the present invention cover the modifications and variations of this invention provided they come within the scope of the appended claims and their equivalents.

What is claimed is:

1. A deflection yoke for a cathode ray tube comprising:

horizontal deflection coils and vertical deflection coils for deflecting electron beams emitted from an electron gun in a horizontal or vertical direction;

a ferrite core for reducing a loss of a magnetic force generated at the horizontal and vertical deflection coils to enhance a magnetic efficiency; and, a holder for fixing the horizontal deflection coils and the vertical deflection coils and the ferrite core to preset positions, and insulating between the horizontal deflection coils and the vertical deflection coils, wherein the ferrite core includes a main ferrite core with a curved surface and supplementary ferrite cores each with a planar surface fitted to the main ferrite core.

2. A deflection yoke as claimed in claim 1, wherein the main ferrite core includes planar surfaces on an opening portion side of the main ferrite core for fitting the supplementary ferrite core.

3. A deflection yoke as claimed in claim 2, wherein the planar surface is formed in a top portion and a bottom portion of the main ferrite core.

4. A deflection yoke as claimed in claim 2, wherein the planar surface is formed starting from the opening portion toward the neck portion direction, at a ratio of a length of the planar surface to an entire length of the main ferrite core in an axis direction of the cathode ray tube being 5%~70%.

5. A deflection yoke as claimed in claim 2, wherein the planar surface started from the opening portion toward the neck portion direction is formed such that an angle '∀' between a line connecting an inner front edge of the opening portion which has an arc form and a center of the opening portion of the main ferrite core and a horizontal line passed through the center of the opening portion is 20E~80E when the main ferrite core is seen from a screen side.

6. A deflection yoke as claimed in claim 5, wherein the angle '∀' between the line connecting an inner front edge of the opening portion which has an arc form and a center of the opening portion of the main ferrite core and a horizontal line passed through the center of the opening portion is preferably 36.7E.

7. A deflection yoke as claimed in claim 2, wherein, of an entire length of the main ferrite core in an axis direction of the cathode ray tube, the planar surface is formed starting from points in front of points on an outer circumference of the main ferrite core onto which the region the transition from a circle to a rectangle of the vertical deflection coils starts are projected.

8. A deflection yoke as claimed in claim 7, wherein, of an entire length of the main ferrite core in an axis direction of the cathode ray tube, the planar surface is formed starting from points in front of points on an outer circumference of the main ferrite core onto which points of the vertical deflection coils of which transition ratio are 0.3 are projected.

9. A deflection yoke as claimed in claim 2, wherein the planar surface in the main ferrite core is formed in parallel to the axis of the cathode ray tube.

10. A deflection yoke as claimed in claim 2, wherein the planar surface in the main ferrite core is formed sloped at an angle to the axis of the cathode ray tube.

11. A deflection yoke as claimed in claim 2, wherein a section of the main ferrite core in parallel to a surface of the opening at any point of the axis of the cathode ray tube has concentric circles or arcs.

12. A deflection yoke as claimed in claim 1, wherein the supplementary ferrite core is a plate with a thickness.

13. A deflection yoke as claimed in claim 12, wherein the supplementary ferrite core is a plate having a width which becomes the smaller as it goes the farther from the opening portion side toward the neck portion side of the main ferrite core.

14. A deflection yoke as claimed in claim 12, wherein the supplementary ferrite core is a semicircular plate in a plan view.

15. A deflection yoke as claimed in claim 12, wherein the supplementary ferrite core is a rectangular or trapezoidal plate in a plan view.

16. A deflection yoke as claimed in claim 12, wherein the supplementary ferrite core includes a step for fitting to the planar surface of the main ferrite core.

17. A deflection yoke as claimed in claim 16, wherein the step includes at least one portion formed to be fit to the planar surface of the main ferrite core.

18. A deflection yoke as claimed in claim 16, wherein the step includes a height formed the lower as it goes the farther to a rear portion.

19. A deflection yoke as claimed in claim 2, wherein the planar surface is formed by sintering a substantially conic main ferrite core and cutting off top and bottom portions of the sintered conic main ferrite core.

20. A deflection yoke as claimed in claim 16, wherein the planar surface is formed by sintering the main ferrite core directly without any additional cutting off process.

21. A deflection yoke as claimed in claim 2, wherein a front surface of the opening portion of the main ferrite core and a front surface of the supplementary ferrite core are aligned to the same vertical plane.

22. A deflection yoke as claimed in claim 16, further comprising a supplementary holder having a through hole for inserting front portions of the opening portion of the main ferrite core and the supplementary ferrite cores, thereby receiving and holding the front portions of the opening portion of the main ferrite core and the supplementary ferrite cores.

23. A deflection yoke for a cathode ray tube comprising:

horizontal deflection coils and vertical deflection coils for deflecting electron beams emitted from an electron gun in a horizontal or vertical direction;

a ferrite core for reducing a loss of a magnetic force generated at the horizontal and vertical deflection coils to enhance a magnetic efficiency; and, a holder for fixing the horizontal deflection coils and the vertical deflection coils and the ferrite core to preset positions, and insulating between the horizontal deflection coils and the vertical deflection coils wherein the ferrite core includes;

a main ferrite core having a radius of curvature, and a planar surface at least one side thereof, and a planar supplementary ferrite core fitted to the main ferrite core.

24. A deflection yoke as claimed in claim 23, wherein the planar surface is formed on a opening portion side of the main ferrite core.

25. A deflection yoke as claimed in claim 24, wherein the planar surface is formed in a top portion and a bottom portion of the main ferrite core.

26. A deflection yoke as claimed in claim 23, wherein the planar surface is formed starting from the opening portion toward the neck portion direction, at a ratio of a length of the planar surface to an entire length of the main ferrite core in an axis direction of the cathode ray tube being 5%~70%.

27. A deflection yoke as claimed in claim 26, wherein the planar surface started from the opening portion toward the neck portion direction is formed such that an angle '∀' between a line connecting an inner front edge of the opening portion which has an arc form and a center of the opening portion of the main ferrite core and a horizontal line passed through the center of the opening portion is 20E~80E when the main ferrite core is seen from a screen side.

28. A deflection yoke as claimed in claim 27, wherein the angle '∀' between the line connecting an inner front edge of the opening portion which has an arc form and a center of the opening portion of the main ferrite core and a horizontal line passed through the center of the opening portion is preferably 36.7E.

29. A deflection yoke as claimed in claim 23, wherein, of an entire length of the main ferrite core in an axis direction of the cathode ray tube, the planar surface is formed starting from points in front of points on an outer circumference of the main ferrite core onto which the region the transition from a circle to a rectangle of the vertical deflection coils starts are projected starting from points in front of points on an outer circumference of the main ferrite core onto which points of the vertical deflection coils 42 of which transition ratio are 0.3 are projected toward the opening portion side of the main ferrite core.

30. A deflection yoke as claimed in claim 29, wherein, of an entire length of the main ferrite core in an axis direction of the cathode ray tube, the planar surface is formed starting from points in front of points on an outer circumference of the main ferrite core onto which points of the vertical deflection coils of which transition ratio are 0.3 are projected.

31. A deflection yoke as claimed in claim 23, wherein the planar surface in the main ferrite core is formed in parallel to the axis of the cathode ray tube.

32. A deflection yoke as claimed in claim 23, wherein the planar surface in the main ferrite core is formed sloped at an angle to the axis of the cathode ray tube.

33. A deflection yoke as claimed in claim 24, wherein a section of the main ferrite core in parallel to a surface of the opening at any point of the axis of the cathode ray tube has concentric circles or arcs.

34. A deflection yoke as claimed in claim 23, wherein the supplementary ferrite core is a plate with a thickness.

35. A deflection yoke as claimed in claim 34, wherein the supplementary ferrite core is a plate having a width which becomes the smaller as it goes from the opening portion side toward the neck portion side of the main ferrite core.

36. A deflection yoke as claimed in claim 34, wherein the supplementary ferrite core is a semicircular plate in a plan view.

37. A deflection yoke as claimed in claim 34, wherein the supplementary ferrite core is a rectangular or trapezoidal plate in a plan view.

38. A deflection yoke as claimed in claim 34, wherein the supplementary ferrite core includes a step for fitting to the planar surface of the main ferrite core.

39. A deflection yoke as claimed in claim 38, wherein the step includes at least one portion formed to be fit to the planar surface of the main ferrite core.

40. A deflection yoke as claimed in claim 38, wherein the step includes a height formed the lower as it goes the farther to a rear portion.

41. A deflection yoke as claimed in claim 23, wherein the planar surface is formed by sintering a substantially conic main ferrite core and cutting off top and bottom portions of the sintered conic main ferrite core.

42. A deflection yoke as claimed in claim 23, wherein the planar surface is formed by sintering the main ferrite core directly without any additional cutting off process.

43. A deflection yoke as claimed in claim 23, wherein a front surface of the opening portion of the main ferrite core and a front surface of the supplementary ferrite core are aligned to the same vertical plane.

44. A deflection yoke as claimed in claim 43, further comprising a supplementary holder having a through hole for inserting front portions of the opening portion of the main ferrite core and the supplementary ferrite cores, thereby receiving and holding the front portions of the opening portion of the main ferrite core and the supplementary ferrite cores.

45. A deflection yoke as claimed in claim 32, wherein the front surface of the supplementary ferrite core is positioned at a point in rear of the front surface of the opening portion of the main ferrite core in an axis direction of the cathode ray tube.

* * * * *